US011879328B2

(12) United States Patent
Seren et al.

(10) Patent No.: US 11,879,328 B2
(45) Date of Patent: Jan. 23, 2024

(54) SEMI-PERMANENT DOWNHOLE SENSOR TOOL

(71) Applicant: Saudi Arabian Oil Company, Dhahran (SA)

(72) Inventors: Huseyin Rahmi Seren, Houston, TX (US); Max Deffenbaugh, Fulshear, TX (US); Erjola Buzi, Houston, TX (US)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 106 days.

(21) Appl. No.: 17/394,813

(22) Filed: Aug. 5, 2021

(65) Prior Publication Data

US 2023/0038860 A1 Feb. 9, 2023

(51) Int. Cl.

| | |
|---|---|
| ***E21B 47/12*** | (2012.01) |
| ***E21B 47/26*** | (2012.01) |
| ***E21B 47/04*** | (2012.01) |

(52) U.S. Cl.

CPC ..... *E21B 47/138* (2020.05); *E21B 47/04* (2013.01); *E21B 47/26* (2020.05)

(58) Field of Classification Search

CPC ..... E21B 47/01; E21B 47/04; E21B 47/06; E21B 47/09; E21B 47/124; E21B 47/10; G05B 19/406

See application file for complete search history.

(56) References Cited

U.S. PATENT DOCUMENTS

| | | | |
|---|---|---|---|
| 2,092,316 | A | 10/1933 | Lane |
| 2,558,427 | A | 6/1951 | Fagan |
| 3,487,484 | A | 1/1970 | Holmes |
| 3,885,212 | A | 5/1975 | Herbert |
| 4,023,092 | A | 5/1977 | Rogers |
| 4,187,909 | A | 2/1980 | Erbstoesser |
| 4,589,285 | A | 5/1986 | Savit |
| 4,611,664 | A | 9/1986 | Osterhoudt et al. |

(Continued)

FOREIGN PATENT DOCUMENTS

| | | |
|---|---|---|
| CA | 2858051 | 11/2016 |
| CN | 103441803 | 12/2013 |

(Continued)

OTHER PUBLICATIONS

U.S. Appl. No. 15/143,128, filed Apr. 29, 2016, Deffenbaugh et al.

(Continued)

*Primary Examiner* — Blake Michener
*Assistant Examiner* — Yanick A Akaragwe
(74) *Attorney, Agent, or Firm* — Osha Bergman Watanabe & Burton LLP

(57) ABSTRACT

A method and a system for collecting data at a fixed point in a wellbore are provided. An exemplary method includes dropping an untethered measurement tool (UMT) in the wellbore, switching a first magnet to drop a ballast from the UMT at a ballast drop condition, switching a second magnet to attach the UMT to a wall of the wellbore at a wall attachment condition. Data is collected in the UMT while the UMT is attached to the wall of the wellbore. The second magnet is switched to release the UMT from the wall of the wellbore at a wall release condition. The UMT is collected from the wellbore and the data is downloaded from the UMT.

32 Claims, 13 Drawing Sheets

(56) References Cited

U.S. PATENT DOCUMENTS 4,650,281 A 3/1987 Jaeger et al.
4,754,640 A 7/1988 Fitzgerald et al.
4,808,925 A 2/1989 Baird
4,855,820 A 8/1989 Barbour
4,983,912 A 1/1991 Roehrlein
5,096,277 A 3/1992 Kleinerman
5,158,440 A 10/1992 Cooper et al.
5,177,997 A 1/1993 Maciejewski
5,188,837 A 2/1993 Domb
5,335,542 A 8/1994 Ramakrishnan et al.
5,387,863 A 2/1995 Lo
5,494,413 A 2/1996 Campen et al.
5,649,811 A 7/1997 Krol, Jr. et al.
5,720,345 A 2/1998 Price et al.
5,729,607 A 3/1998 DeFries et al.
5,767,668 A 6/1998 Durand
5,944,195 A 8/1999 Huang et al.
6,057,750 A * 5/2000 Sheng ..... H01F 7/1615 335/229
6,084,403 A 7/2000 Sinclair et al.
6,250,848 B1 6/2001 Moridis et al.
6,380,534 B1 4/2002 Mahmoud et al.
6,411,084 B1 6/2002 Yoo
6,534,980 B2 3/2003 Toufaily et al.
6,555,807 B2 4/2003 Clayton et al.
6,808,371 B2 10/2004 Niwatsukino et al.
6,811,382 B2 11/2004 Buchanan et al.
6,853,200 B2 2/2005 Munser
6,856,132 B2 2/2005 Appel et al.
7,021,905 B2 4/2006 Torrey et al.
7,049,272 B2 5/2006 Sinclair et al.
7,363,967 B2 4/2008 Burris, II et al.
7,376,514 B2 5/2008 Habashy et al.
7,622,915 B2 11/2009 Sugiyama
7,831,205 B2 11/2010 Jack et al.
7,898,494 B2 3/2011 Brune
8,074,713 B2 12/2011 Ramos et al.
8,229,699 B2 7/2012 Jin
8,237,444 B2 8/2012 Simon
8,269,501 B2 9/2012 Schmidt et al.
8,272,455 B2 9/2012 Guimerans
8,638,104 B2 1/2014 Barber et al.
8,661,907 B2 3/2014 Davis et al.
8,794,062 B2 8/2014 DiGoggio et al.
8,816,689 B2 8/2014 Colombo et al.
8,877,954 B2 11/2014 Giesenberg et al.
8,884,624 B2 11/2014 Homan et al.
8,885,559 B2 11/2014 Schmidt et al.
9,051,829 B2 6/2015 Xie
9,080,097 B2 7/2015 Gupta et al.
9,129,728 B2 9/2015 Edbury
9,133,709 B2 9/2015 Huh et al.
9,528,322 B2 12/2016 MacDonald
9,562,987 B2 2/2017 Guner et al.
9,587,477 B2 3/2017 Lafferty et al.
9,650,851 B2 5/2017 Whitsitt et al.
10,117,042 B2 10/2018 Akyildiz et al.
10,273,399 B2 4/2019 Cox et al.
10,308,865 B2 6/2019 Cox et al.
10,308,895 B2 6/2019 Vidal et al.
10,316,645 B2 6/2019 Ingraham et al.
10,323,644 B1 6/2019 Shakirov et al.
10,349,249 B2 7/2019 Akyildiz et al.
10,444,065 B2 10/2019 Schmidt et al.
10,487,259 B2 11/2019 Cox et al.
10,501,682 B2 12/2019 Cox et al.
2003/0220204 A1 11/2003 Baran et al.
2004/0236512 A1 11/2004 DiFoggio et al.
2005/0152280 A1 7/2005 Pollin
2005/0241825 A1 11/2005 Burris, II et al.
2006/0076956 A1 4/2006 Sjolie et al.
2006/0105052 A1 5/2006 Acar et al.
2006/0157239 A1 7/2006 Ramos et al.
2006/0213662 A1 9/2006 Creel et al.
2007/0114030 A1 5/2007 Todd et al.
2008/0047337 A1 2/2008 Chemali et al.
2008/0290876 A1 11/2008 Ameen
2009/0211816 A1* 8/2009 Williams ..... E21B 37/00 175/328
2009/0222921 A1 9/2009 Mukhopadhyay et al.
2009/0255669 A1 10/2009 Ayan et al.
2009/0264067 A1 10/2009 Pahlavan
2009/0264768 A1 10/2009 Courtney
2009/0277625 A1 11/2009 Bai et al.
2009/0289627 A1 11/2009 Johansen et al.
2009/0302847 A1 12/2009 Knizhnik
2010/0191110 A1 7/2010 Insana et al.
2010/0200744 A1 8/2010 Pearce et al.
2010/0227557 A1 9/2010 Won et al.
2010/0241407 A1 9/2010 Hsu et al.
2011/0030949 A1 2/2011 Weaver et al.
2011/0100634 A1 5/2011 Williamson
2011/0221443 A1 9/2011 Bittar
2011/0253373 A1 10/2011 Kumar et al.
2012/0092960 A1 4/2012 Gaston et al.
2012/0135080 A1 5/2012 Bromberg et al.
2012/0145458 A1* 6/2012 Downton ..... E04D 13/165 175/231
2012/0216628 A1* 8/2012 Rezgui ..... G01F 1/44 73/861.42
2012/0281643 A1 11/2012 Sun
2012/0285695 A1 11/2012 Lafferty et al.
2013/0043887 A1 2/2013 Ziolkowski et al.
2013/0073208 A1 3/2013 Dorovsky
2013/0091292 A1 4/2013 Kim et al.
2013/0109261 A1 5/2013 Koene
2013/0186645 A1 7/2013 Hall
2013/0192349 A1 8/2013 Ramkumar et al.
2013/0244914 A1 9/2013 Wu et al.
2013/0250812 A1 9/2013 Rath
2013/0296453 A1 11/2013 Giesenberg et al.
2013/0312970 A1 11/2013 Lafitte et al.
2013/0332015 A1 12/2013 Dextreit et al.
2013/0341030 A1 12/2013 Brannon et al.
2014/0036628 A1 2/2014 Hill et al.
2014/0041862 A1 2/2014 Ersoz
2014/0060832 A1 3/2014 Mahoney et al.
2014/0110102 A1 4/2014 Hall
2014/0133276 A1 5/2014 Volker
2014/0151029 A1* 6/2014 Parsche ..... E21B 36/04 166/66.5
2014/0159715 A1 6/2014 McEwen-King
2014/0190700 A1 7/2014 Tang et al.
2014/0200511 A1 7/2014 Boyden
2014/0366069 A1 12/2014 Ramamurthi
2015/0000657 A1 1/2015 Varvello et al.
2015/0013983 A1 1/2015 Alwattari
2015/0036482 A1 2/2015 Schmidt et al.
2015/0050741 A1 2/2015 Tour et al.
2015/0094964 A1 4/2015 Kuroda et al.
2015/0118501 A1 4/2015 Lu
2015/0159079 A1 6/2015 Huh et al.
2015/0181315 A1 6/2015 Vuran et al.
2015/0192436 A1 7/2015 Farhadiroushan et al.
2015/0247818 A1* 9/2015 Silvester ..... G01N 27/49 429/492
2015/0264627 A1 9/2015 Perdomo et al.
2015/0268370 A1 9/2015 Johnston et al.
2015/0275649 A1 10/2015 Orban et al.
2015/0319630 A1 11/2015 Kerberg
2015/0337874 A1 11/2015 Park
2015/0368547 A1 12/2015 Lesko et al.
2015/0376493 A1 12/2015 Huh et al.
2016/0040514 A1 2/2016 Rahmani et al.
2016/0083641 A1 3/2016 Gamage
2016/0109611 A1 4/2016 Simon
2016/0138964 A1 5/2016 Brengartner et al.
2016/0146662 A1 5/2016 Stokely et al.
2016/0251935 A1 9/2016 Jacob et al.
2016/0264846 A1 9/2016 Bennetzen et al.
2016/0305447 A1 10/2016 Dreiss et al.
2016/0320769 A1* 11/2016 Deffenbaugh ..... E21B 47/06
2017/0074093 A1 3/2017 Adebayo
2017/0154714 A1* 6/2017 Katayama ..... H01F 7/1646

(56) References Cited

U.S. PATENT DOCUMENTS

| | | | | |
|---|---|---|---|---|
| 2018/0051553 | A1* | 2/2018 | Indo | E21B 47/06 |
| 2018/0292558 | A1 | 10/2018 | Wilson et al. | |
| 2018/0313735 | A1 | 11/2018 | Gallagher | |
| 2018/0320059 | A1 | 11/2018 | Cox et al. | |
| 2019/0086348 | A1* | 3/2019 | Difoggio | E21B 47/07 |
| 2019/0226900 | A1 | 7/2019 | Brengartner et al. | |
| 2019/0242808 | A1* | 8/2019 | Chen | E21B 47/00 |
| 2021/0017827 | A1 | 1/2021 | Seren et al. | |
| 2021/0041591 | A1 | 2/2021 | Riachentsev | |
| 2021/0208046 | A1 | 7/2021 | Gonzalez et al. | |

FOREIGN PATENT DOCUMENTS

| | | |
|---|---|---|
| CN | 103701567 | 4/2014 |
| DE | 4419684 | 12/1995 |
| EP | 1721603 | 11/2006 |
| EP | 2789793 | 10/2014 |
| EP | 2801696 | 11/2014 |
| EP | 2954151 | 12/2015 |
| EP | 3196402 | 7/2017 |
| GB | 2442745 | 4/2011 |
| RU | 2025747 | 12/1994 |
| WO | WO 1998046857 | 10/1998 |
| WO | WO 2000023824 | 4/2000 |
| WO | WO 2004113677 | 12/2004 |
| WO | WO 2011063023 | 5/2011 |
| WO | WO 2012154332 | 11/2012 |
| WO | WO 2012158478 | 11/2012 |
| WO | WO 2013126388 | 8/2013 |
| WO | WO 2013142869 | 9/2013 |
| WO | WO 2014049698 | 4/2014 |
| WO | WO 2014066793 | 5/2014 |
| WO | WO 2014100275 | 6/2014 |
| WO | WO 2015020642 | 2/2015 |
| WO | WO 2015044446 | 4/2015 |
| WO | WO 2015084926 | 6/2015 |
| WO | WO 2015086062 | 6/2015 |
| WO | WO 2015095168 | 6/2015 |
| WO | WO 2015134705 | 9/2015 |
| WO | WO 2017205565 | 11/2017 |
| WO | WO 2018022198 | 2/2018 |

OTHER PUBLICATIONS

U.S. Appl. No. 17/164,067, filed Feb. 1, 2021, Seren et al.
U.S. Appl. No. 17/234,555, filed Apr. 19, 2021, Seren et al.
Agbinya, "A Magneto-Inductive Link Budget for Wireless Power Transfer and Inductive Communication Systems," Progress in Electromagnetics Research C, 2013, 37: 15-28, 14 pages.
Agbinya, "Investigation of Near Field Inductive Communication System Models, Channels and Experiments," Progress in Electromagnetics Research B, 2013, 49: 129-153, 25 pages.
Akyildiz et al., "SoftWater: Software-Defined Networking for Next-Generation Underwater Communication Systems," Ad Hoc Networks, Apr. 8, 2016, 46: 1-11, 11 pages.
Americanpiezo.com [online], "Stripe Actuators," available on or before Mar. 13, 2011, via Internet Archive: Wayback Machine URL <https://web.archive.org/web/20110313073802/https://www.americanpiezo.com/standard-products/stripe-actuators.html>, [retrived on Apr. 6, 2018], retrieved from: URL <https://www.americanpiezo.com/standard-products/stripe-actuators.html>, 2 pages.
Assaf et al., "Accurate Sensors Localization in Underground Mines and Tunnels," IEEE, 2015, 6 pages.
Bagaria et al., "Iron Oxide Nanoparticles Grafted with Sulfonated Copolymers are Stable in Concentrated Brine at Elevated Temperatures and Weakly Adsob on Silica," ACS Applied Materials & Interfaces, Mar. 25, 2013, 5:8 (3329-3339), 11 pages.
Baker et al., "Permanent monitoring-looking at lifetime reservoir dynamics," Oilfield Review, 1995, 7:4 (32-46), 15 pages.
Bala et al., "Interaction of Different Metal Ions with Carboxylic Acid Group: A Quntitative Study," The Journal of Physical Chemistry A, Jun. 2007, 111:28 (6183-6190), 8 pages.
Bar-Kochba et al., "A Fast Iterative Digital Volume Correlation Technique for Large Deformation Measurements," Experimental Mechanics, Feb. 2014, 55:261-274, 14 pages.
Bayspec.com [online], "SuperGamut NIR Spectrometer," available on or before Feb. 2014, [retrieved Apr. 18, 20180], retrieved from: URL <http://www.bayspec.com/wp-content/uploads/2014/02/BaySpec-Datasheet-nir-swir.pdf>, 6 pages.
Bell et al., "Subsurface Discrimination Using Electromagnetic Induction Sensors," IEEE Transactions on Geoscience and Remote Sensing, Jun. 2001, 39:6, 8 pages.
Biswas et al., "Semidefinite Programming Approaches for Sensor Network Localization with Noisy Distance Measurements," IEEE Trans. on Automation Science and Engineering, Oct. 2006, 3:4 (360-371), 12 pages.
Blunt, "Effects of heterogeneity and wetting on relative permeability using pore level modeling", SPE Journal 2:01 (70-87), Mar. 1997, 19 pages.
Boman, "DAS technology expands fiber optic applications for oil, gas industry," Rigzone, May 4, 2015, 4 pages.
Bryant and Blunt, "Predition of relative permeability in simple porous media" Phys. Rev. A, Aug. 1992, 46:4 (2004-2011), 8 pages.
Bulkac et al., "Digital volume correlation: review of progress and challenges," Experimental Mechanics, 2018, 58:5 (661-708), 127 pages.
Chappell and Lancaser, "Comparison of methodological uncertanties within permeability measurements" Hydrological Processes, Jan. 2007, 21:18 (2504-2514), 11 pages.
Chen et al., "Aggregation Kinetics of Alginate-Coated Hematite Nanoparticles in Monovalent and Divalent Electrolytes," Enviromental Science & Technology, Mar. 2006, 40:5 (1516-1523), 8 pages.
Chen et al., "Distributed Source Localization in Wireless Underground Sensor Networks," arXIiv: 1112.4035v1, Dec. 17, 2011, 21 pages.
Chen et al., "Hydration Repulsion between Carbohydrate Surfaces Mediated by Temperature and Specific Ions," Scientific Reports, Jun. 23, 2016, 6: 1-10, 10 pages.
Cole et al., "Polyethylene Glycol Modified, Cross-Linked Starch-Coated Iron Oxide Nanoparticles for Enhanced Magnetic tumor Targeting," Biomaterials, Mar. 1, 2011, 32:8 (2183-2193), 11 pages.
Colombo and McNeice, "Quantifying surface-to-resrvoir electromagnetics for waterflood monitoring in a Saudi Arabian carbonate reservoir," Geophysics, Nov. 2013, 78:6, 17 pages.
Commons.wikimedia.org, [online], "File:6DOF.svg," retrieved from URL <https://commons.wikimedia.org/w/index.php?curid=38429678>, retrieved on Aug. 25, 2020, available on or before Feb. 16, 2015, 5 pages.
Costa et al., "Distributed Weighted-Multidimensional Scaling for Node Localization in Sensor Networks," ACM Trans. Sen. Netw., Feb. 2006, 2:1 (39-64), 26 pages.
Cui et al., "Cross-Layer Energy and Delay Optimization in Small-Scale Sensor Networks," IEEE Transactions on Wireless Communications, Oct. 2007, 6:10, 12 pages.
Danfoss, "Facts Worth Knowing about Frequency Converters," Handbook VLT Frequency Converters, Danfoss Engineering Tomorrow, 180 pages.
De et al., "An Integrated Cross-Layer Study of Wireless CDMA Sensor Networks," IEEE Journal on Selected Areas in Communications, Sep. 2004, 22:7, 15 pages.
Deffenbaugh et al., "An untethered sensor for well logging," IEEE Sensores Applications Symposium (SAS) Mar. 2017, 1-5, 5 pages.
DiCarlo et al., "Three-phase relative permeability of water-wet, oil-wet, and mixed-wet sandpacks" SPE Journal, Mar. 2000, 5:01 (82-91), 10 pages.
Dixit et al., "A pore-level investigation of relative permeability hysteresis in water-wet systems" SPE Journal, Jun. 1998, 3:02 (115-123), 9 pages.
Elprocus.com [online], "Designing of 12V to 24V DC Converter Circuit using LM324," available on or before 2013, retrieved from URL <https://www.elprocus.com/12v-to-24v-dc-converter-using-lm324/>, retrieved on Aug. 11, 2021, 7 pages.

(56) References Cited

OTHER PUBLICATIONS

Estrada et al., "Intuitive Interface for the Quantitative Evaluation of Speckle Patterns for Use in Digital Image and Volume Correlation Techniques," J. Applied Mechanics, Sep. 2015, 82:9 (095001), 5 pages.
Fatt, "The network model of porous media" Petroleum Transactions, Dec. 1956, 207: 144-181, 38 pages.
Gulbahar et al., "A Communication Theoretical Modeling and Analysis of Underwater Magneto-Inductive Wireless Channels," IEEE Transactions on Wiresless Communiations, Sep. 2012, 11:9, 9 pages.
Heiba et al., "Percolation theory of two-phase relative permeability" SPE Reservoir Eng. 7:01 (123-132), Feb. 1992, 11 pages.
Hui and Blunt, "Effects of wettability on three-phase flow in porous media" J. Phys. Chem. 104:16 (3833-3845), Feb. 2000, 13 pages.
Hunting-intl.com [online], "Mechanical Centralizers and Decentralizers" Mar. 2015, [retrieved on Apr. 7, 2021], retrieved from: URL <http://www.hunting-intl.com/titan/wireline-hardware-and-accessories/mechanical-centralizers-and-decentralizers>, 1 page.
Jacobs et al., "Downhole fiber-optic monitoring: an evolving technology," Society of Petroleum Engineers, Journal of Petroleum Technology, Aug. 2014, 66:08, 2 pages, Abstrct only.
Ji et al., "Beyond Convex Relaxation: A Polynomial-Time Non-Convex Optimization Approach to Network Localization," Proceedings, IEEE INFOCOM, Apr. 2013, 2499-2507, 9 pages.
Kannan et al., "Analysis of Flip Ambiguities for Robust Sensor Network Localization," IEEE Trans. Veh. Technol., May 2010, 59:4 (2057-2070), 14 pages.
Karalis, "Efficient Wireless Non-Radiative Mid-Range Energy Transfer," Annals of Physics, 2008, 323: 34-48, 15 pages.
Kisseleff et al., "Throughput of the Magnetic Induction Based Wireless Underground Sensor Networks: Key Optimization Techniques," IEEE Transactions on Communications, Dec. 2014, 62:12, 14 pages.
Knaian, "Electropermanent magnetic connectors and actuators: devices and their applications in programmable matter," PhD thesis, Massachusetts Institute of Technology, 2010, 206 pages.
Kramer, "Water-Soluble Dendritic Architectures with Carbohydrate Shells for the Templation and Stabilization of Catalytically Active Metal Nanoparticles," published by ACS, Macromolecules, Aug. 27, 2005, 38:20 (8308-8315), 8 pages.
Li et al., "In Situ Estimation of Relative Permeability from Resistivity Measurements," Petroleum Geoscience, 2014, 20: 143-151, 10 pages.
Li, "Collaborative Localization with Received-Signal Strength in Wireless Sensor Networks," IEEE Trans. Veh. Technol., Nov. 2007, 56:6 (3807-3817), 11 pages.
Lin et al., "A Tutorial on Cross-Layer Optimization in Wireless Networks," IEEE Journal on Selected Areas in Communications, Aug. 2006, 24:8, 12 pages.
Lin et al., "Magnetic Induction-Based Localization in Randomly-Deployed Wireless Underground Sensor Networks," IEEE Internet of Things Journal, Jul. 20, 2017, 1-11, 11 pages.
Machinedesign.com [online], Frances Richards, "Motors for efficiency: Permanent-magnet, reluctance, and induction motors compared," Apr. 2013, retrieved on Nov. 11, 2020, retrieved from URL <https://www.machinedesign.com/motors-drives/article/21832406/motors-for-efficiency-permanentmagnet-reluctance-and-induction-motors-compared>, 4 pages.
Mahmud et. al "Effect of network topology on two-hase imbibition relative permeability" Transport in Porous Media, Feb. 2007, 66:3 (481-493), 14 pages.
Martinez et al., "Polysaccharide-based Nanoparticles for Controlled Release Formulations," The Delivery of Nanoparticles, May 2012, 185-222, 39 pages.
Masihpour et al., "Multihop Relay Techniques for Communication Range Extension in Near-Field Magnetic Induction Communication Systems," Journal of Networks, May 2013, 8:5, 13 pages.
Nagy et. al, "Comparison of permeability testing methods," Proceedings of the 18th International Conference on Soil Mechanics and Geotechnical Engineering, 2013, 399-402, 4 pages.
Nie, "Sum of Squares Method for Sensor Network Localization," Computational Optimization and Applications, 2007, 43:2 (151-179), 29 pages.
Niewiadomska-Szynkiewicz, "Localization in Wireless Sensor Networks: Classification and Evaluation of Techniques," Int. J. Appl. Mat. Comput. Sci., 2012, 22:2 (281-297), 17 pages.
Optasense.com [online], "Oilfield Services," available on or before Jun. 2, 2015, via Wayback Machine URL <https://web.archive.org/web/20150602040413/http://www.optasense.com/our-solutions/oilfield-services/>, [retrieved Apr. 6, 2018], retrieved from URL <http://www.optasense.com/our-solutions/oilfield-services/>, 1 page.
Piceramic.com [online], "Rectangular Bending Elements," available on or before Mar. 31, 2017, via Internet Archive: Wayback Machine URL <https://web.archive.org/web/20170331054949/https://www.piceramic.com/en/products/piezoceramic-components/bending-elements/>, [retrieved Apr. 6, 2018], retrieved from: URL <https://www.piceramic.com/en/products/piezoceramic-components/bending-elements/>, 2 pages.
Pompili et al., "A Multimedia Cross-Layer Protocol for Underwater Acoustic Sensor Networks," IEEE Transactions on Wireless Communications, Sep. 2010, 9:9, 10 pages.
Purcell, "Capillary pressures—their measurement using mercury and the calculation of permeability therefrom" Journal of Petroleum Technology, Feb. 1949, 1:02 (39-48), 10 pages.
Rahmani et al., "Characterizing Reservoir Heterogeneities Using Magnetic Nanoparticles," SPE Resrvoir Simulation Symposium, May 2015, 25 pages.
Rio-lasters.com [online], "Redfern Integrated Optics (RIO) Colorado Tunable Laser Source," available on or before Sep. 1, 2016, via Wayback Machine URL <https://web.archive.org/web/20160901172454/http://www.rio-lasers.com/pdf/Rio_Colorado_Product%20Brief_1.24.14.pdf> [retrieved Apr. 6, 2018], retrieved from URL <http://www.rio-lasers.com/pdf/Rio_Colorado_ProductBrief_1.24.14.pdf>, 2 pages.
Saeki et al., "Upper and lower critical solution temperatures in poly (ethylene glycol) solutions," Polymer, Aug. 1976, 17:8 (685-689), 5 pages.
Sbl.com [online], "Distributed Acoustic Sensing Technology," available on or before Feb. 11, 2017, via Wayback Machine URL <https://web.archive.org/web/20170211002616/https://www.slb.com/services/characterization/geophysics/wireline.distributed-acoustic-seismic-sensing.aspx>, [retrieved on Apr. 6, 2018], retrieved from URL <https://www.slb.com/services/characterization/geophysics/wireline/distributed-acoustic-seismic-sensing.aspx>, 1 page.
Sedlar et al., "Optical fiber magnetic field sensors with ceramic magnetostricive jackets," Applied Optics, Sep. 20, 1996, 35:27, 2 pages, abstact only.
Seren et al., "Wireless Communication and Charging Platform for Sensor Ball," IEEE—Sensors, 2019, 3 pages.
ShamsiJazeyi et al., "Polymer-Coated Nanoparticles for Enhance Oil Recovery," Journal of Applied Polymer Science, Aug. 5, 2014, 131:15, 13 pages.
Simonetto et al., "Distributed Maximum Likelihood Sensor Network Localization," IEEE Transactions on Signal Processing, Mar. 15, 2014, 62:6 (1424-1437), 14 pages.
Simpson et al., "A Touch, Truly Multiphase Downhole Pump for Unconventional Wells," SPE-185152-MS, Society of Petroleum Engineers (SPE), presented at the SPE Electric Submersible Pump Symposium, the Woodlands, Texas, Apr. 24-28, 2017, 20 pages.
Steminc.com [online], "Piezo Ceramic Plate 26x8x0.7mm 108 KHz," available on or before Dec. 30, 2013, via Internet Archive Wayback Machine URL <https://web.archive.org/web/20131230010212/https://www.steminc.com/PZT/en/piezo-ceraminc-plate-26x8x7mm-108-khz>, [retrieved on Apr. 6, 2018], retrieved from URL <https://www.steminc.com/PZT/en/piezo-ceraminc-plate-26x8x7mm-108khz>, 1 page.
Sun et al., "Design of the fiber optic distributed acoustic sensor based on Michelson interferometer and its location application," Optical Engineering, 42, Oct. 1, 2003, 1 pages, Abstact only.

(56) References Cited

OTHER PUBLICATIONS

Sun et al., "Optical Development for Magnetic Induction-Baed Wireless Networks in Challenged Environments," IEEE Transactions on Wireless Cormmunications, Mar. 2013, 12:3, 10 pages.
Udd, "An overview of fiber-optic sensores," Review of Science Instuments, Jun. 1995, 66: 4015, 16 pages, Abstract only.
Vuran et al., "Communication Through Soil in Wireless Underground Sensor Networks—Theory and Practice," 2010, 309-347, 39 pages.
Vuran et al., "XLP: A Cross-Layer Protocol for Efficient Communication in Wireless Sensor Networks," IEEE Transactions on Mobile Computing, Nov. 2010, 9:11, 14 pages.
Wikipedia.com [online], "Distributed acoustic sensing", Jan. 17, 2012, [retrieved on Feb. 23, 2018], retrieved from URL <https://en.wikipedia.org/wiki/Distributed_acoustic_sensing>, 5 pages.
Wikipedia.org [online], "Metacentric Height" Nov. 2003, [retrieved on Apr. 7, 2021], retrieved from: URL <https://en.wikipedia.org/wiki/Metacentric_height>, 7 pages.
Yamamoto, "Imaging the permeability structure within the near-surface sediments by acoustic crosswell tomography," Journal of Applied Geophysics, 47:1, May 2001, 11 pages.
Zhan et al., "Characterization of Reservoir Heterogeneity Through Fluid Movement Monitoring with Deep Electromagnetic and Pressure Measurements," SPE 116328, Society of Petroleum Engineers (SPE), SPE International, preseneted at the 2008 SPE Annual Technical Conference and Exhibition, Sep. 21-24, 2008, 16 pages.
Zhai et al., "Chromatographic Separation of Highly Soluble Diamond Nanoparticles Prepared by Polyglycerol Grafting," Angewandte Chemie International Edition, Feb. 7, 2011, 50:6 (1388-1392), 5 pages.
PCT International Search Report and Written Opinion in International Appln. No. PCT/US2022/074524, dated Nov. 16, 2022, 13 pages.
Seren et al., "Electro-permanent magnetic weight release mechanism for buoyancy control of an autonomous well-logging tool," AIP Advances, American Institute of Physics, Feb. 2021, 11(2), 7 pages.

* cited by examiner

100

600

700

800

1000

1100

1200

1300

SEMI-PERMANENT DOWNHOLE SENSOR TOOL

TECHNICAL FIELD

The present disclosure is directed to a method and device for obtaining measurements of downhole properties along a subterranean well. More particularly, embodiments of the present invention relate to an untethered measurement tool that can temporarily attached to the wall of a wellbore to collect data in the wellbore.

BACKGROUND

During oil and gas production a variety of properties are measured within the well to guide adjustment of production rates and to determine when maintenance is needed. These can include measurements of pressures, temperatures, chemical composition of downhole fluids, amounts and flow rates of downhole fluids, amounts and rates of corrosion or scale buildup, and sounds or vibrations that may be emitted from fluids flowing within the well, fluids flowing behind the casing, downhole pumps and valves, microseismic activity near the well which is either naturally occurring or induced by hydraulic fracturing, and manmade seismic signals produced by a seismic source at the surface or in a borehole. These measurements are generally obtained by lowering a measurement tool into the well when data is needed, recording the data of interest, and then pulling the tool back out of the well by its cable. The tool can be a wireline tool, slickline tool, or a seismic sensor or array of seismic sensors such as geophones or hydrophones. If data is required more frequently or continually, it can be too expensive to obtain it using such tools and permanently deployed sensors may be used. These permanent sensors are generally either fiber optic or electronic. Fiber optic cables are often deployed as permanent sensors, but these are limited to measuring temperature and strain or acoustic signals, and the interrogator boxes required at the surface to acquire the data from the fiber can be prohibitively expensive. Electronic sensors can be permanently deployed in wells, but electronics tends to be unreliable when deployed for years at downhole temperatures and the electrical cable for the sensor can be a significant expense. Additionally, there is a risk of damaging fiber optics or electrical cables during installation, and it is often difficult or impossible to replace a failed cable or sensor. Alternatively, a sensor with battery and memory can be hanged inside a well using a wireline. The tool with the recorded data can be collected back at a later time. There are limited number of depths where such a tool can be hanged. Therefore, it limits permanent sensor placement to these depths.

Generally, downhole properties along a well are measured using tethered logging tools, which are suspended on a cable, and lowered into the wellbore using, for example, a winch mounted in a logging truck and a crane. In some cases, the conventional tethered logging tools are pushed into the wellbore using, for example, coiled tubing, or pushed or pulled along the wellbore using a tractor, or other similar driving mechanism. Conventional tethered logging tools and the cable or wiring attached thereto are generally bulky, requiring specialized vehicles and equipment, and a specialized crew of technicians to deploy and operate. The use of these tools increases the expense associated with well logging and can introduce undesirable delays in obtaining needed data.

SUMMARY

An embodiment described in examples herein provides an untethered measurement tool (UMT) for logging data at a fixed location in a wellbore. The untethered measurement tool including a housing, wherein the housing is formed from a material that is buoyant in fluids in the wellbore. The UMT includes an unpowered magnet that is switchable between an external field state and a circular field state, wherein the external field state couples the untethered measurement tool to a ferromagnetic surface, and a power boost circuit to charge a capacitor to switch a state of the unpowered magnet. The UMT also includes a sensor configured to measure data in the wellbore and a controller. The controller includes a processor and a storage medium. The storage medium includes instructions to direct the processor to measure data correlating to a depth in the wellbore and switch the unpowered magnet to the circular field state at a target depth, dropping an attached ballast. The storage medium includes instructions to direct the processor to switch the unpowered magnet to the external field state, coupling the untethered measurement tool to a wall of the wellbore, log data from the sensor in the storage medium, and switch the unpowered magnet to the circular field state to release the untethered measurement tool.

Another embodiment described in examples herein provides a method for collecting data at a fixed point in a wellbore. The method includes dropping an untethered measurement tool (UMT) in the wellbore, switching a first magnet to drop a ballast from the UMT at a ballast drop condition, and switching a second magnet to attach the UMT to a wall of the wellbore at a wall attachment condition. The method includes collecting data in the UMT while the UMT is attached to the wall of the wellbore, and switching the second magnet to release the UMT from the wall of the wellbore at a wall release condition. The method also includes collecting the UMT from the wellbore and downloading the data from the UMT.

DETAILED DESCRIPTION

A small, untethered measurement tool (UMT) for logging downhole properties at a fixed point in a wellbore is provided herein, along with a method for using the untethered measurement tool. The UMT can be deployed by an individual in the field, without using logging crews, vehicles, or equipment. The UMT has a buoyant case and an attached ballast. The ballast is sufficient to give the UMT a negative buoyancy in the well fluids, allowing it to sink. At a programmed point, for example, in depth or time, the ballast is dropped. As described herein, this is performed by a switchable magnet that changes polarity upon receiving a magnetic pulse through a coil. After the ballast is dropped, the switchable magnet, or another switchable magnet, is switched to allow the UMT to attach to the wall of the wellbore and collect data. After a programmed time, event, or after the logging memory is filled, the switchable magnet is switched back off, allowing the UMT to float back up to the top of the wellbore for retrieval. After retrieval, the data is downloaded from the UMT. This is generally performed by a wireless communication system built into the UMT, such as a light emitting diode (LED) communications system, or a radio loop. In some embodiments, the radio loop is used both for communications and for a wireless charging system used to charge batteries in the UMT.

Figure 1:
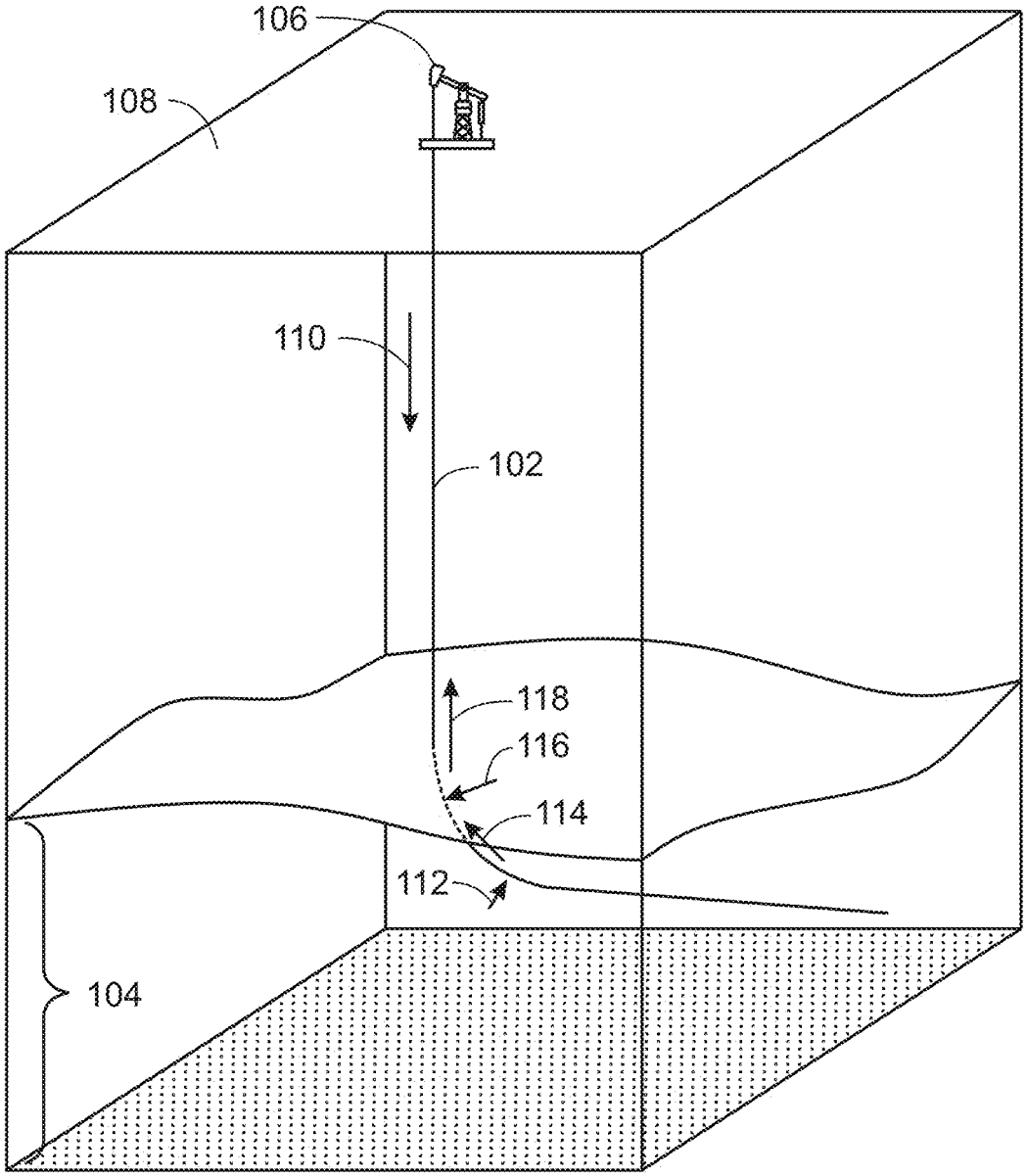
FIG. 1 is a schematic drawing of a wellbore into which an UMT is dropped.

FIG. 1 is a schematic drawing 100 of a wellbore 102 into which an UMT is dropped. The wellbore 102 is generally a drilled well that includes steel tubulars, such as casing or production tubing. The wellbore 102 is drilled to a reservoir layer 104, from which hydrocarbons, or other materials, are produced.

A production unit 106 may be disconnected at the surface 108 to allow the UMT to be inserted into the wellbore 102. The UMT sinks 110 in the wellbore 102, as an attached ballast makes the UMT heavier than the fluids in the wellbore 102. At a programmed point 112 in the wellbore 102, for example, at a preselected pressure, the ballast is dropped, and the UMT begins to ascend 114. At a second programmed point 116, the UMT attaches to the wall of the wellbore 102 and collects data on conditions in the wellbore 102. The conditions may include temperature, pressure, and composition, such as oil/water ratio, and the like.

After a predetermined condition, for example, after a predetermined time, a data memory is filled, or a battery charge is below a limit, the UMT detaches from the wall of the wellbore and ascends 118 to the surface 108. At the surface 108, the UMT is collected from the top of the wellbore 102, and the data collected is downloaded.

Figure 2A:
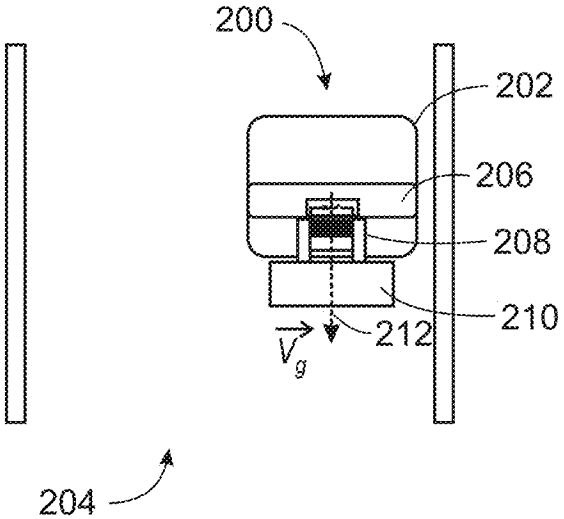
FIGS. 2A-2C are schematic diagrams of an UMT as described herein.
Figure 2B:
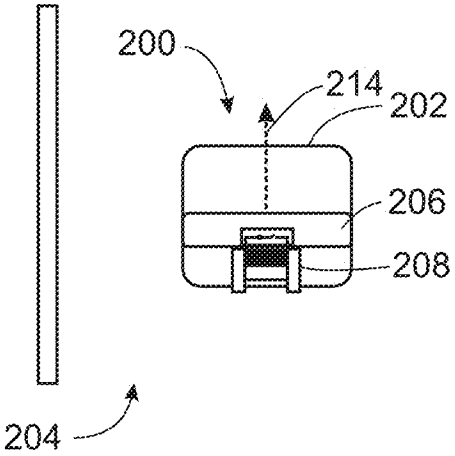
Figure 2C:
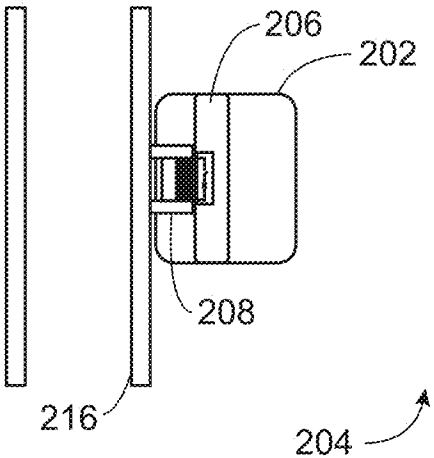

FIGS. 2A-2C are schematic diagrams of an UMT 200 as described herein. As shown in FIG. 2A, the UMT 200 includes a case 202 formed from a buoyant material. In some embodiments, the buoyant material is a hydrocarbon resistant polymer, such as a polypropylene foam or a polyurethane foam, among others. The buoyant material provides the UMT 200 with a total density that is lower than the density of the fluids in the wellbore. Accordingly, the UMT 200 will float to the top of a wellbore 204 without additional weight, as shown in FIG. 2B.

In one embodiment, the UMT 200 is operated at ambient pressure conditions, as cases used to protect against high pressure conditions would increase the density. Accordingly, the internal components, such as an electronics package 206, including a processor and sensor, among others, and a switchable magnet are sealed to protect from fluids in the wellbore 204. In some embodiments, this is performed by placing the internal components in the case 202 and filling the case 202 with a potting compound, such as a silicone polymer, among others.

In one embodiment, the UMT has an atmospheric housing whose effective density is less than well fluids.

An electronics package 206 includes a sensor, processor, and memory to collect data from the sensor and store the data in the memory. The electronics package 206 is described further with respect to FIG. 13.

The electronics package 206 also includes a magnet control circuit that controls a switchable magnet 208. As used herein, a switchable magnet 208 includes at least two permanent magnets of which one can be changed in polarity to enhance or cancel the magnetic field of the other magnet. Although the switchable magnet 208 is not permanently powered, the condition in which the polarity of one magnet is switched to enhance the magnetic field of the other magnet, allowing flux lines to extend outside of the housing, is termed the "on state" herein. Similarly, the condition in which the polarity of the one magnet is switched to cancel the magnetic field of the other magnet, blocking flux lines from extending outside of the housing, is termed the "off state" herein. The switchable magnet 208 is described further with respect to FIGS. 5A and 5B.

In an initial deployment configuration, the UMT 200 has a ballast 210, such as a steel plate, which is held by the switchable magnet 208 which is in the on state. The ballast 210 increases the weight of the UMT 200, and thus, increases the total density of the UMT 200 over the density of the fluids in the wellbore. In some embodiments, the weight of the ballast 210 is adjusted to control the rate of descent into the wellbore, based on the flow of the fluids in the wellbore.

As shown in FIG. 2A, the UMT 200 is launched into the wellbore 204 and descends 212 to a point where a measurement matches a target, such as a target pressure, a target temperature, a target oil/water composition, and the like. Multiple targets can be programmed into the UMT 200, depending on the sensor types present. For example, if the UMT 200 does not detect a target temperature, a target oil/water composition, or another target, a pressure sensor may activate the next operations. At the target measurement, the electronics package 206 switches the switchable magnet 208 from the on state to the off state, dropping the ballast 210, and allowing the UMT 200 to begin to ascend in the wellbore 204.

After dropping the ballast 210, for example, at a second target measurement, the electronics package 206 switches the switchable magnet 208 from the off state to the on state, which allows the UMT 200 to attach to a ferromagnetic surface, such as a steel lining 216, e.g., the casing or tubing, within the wellbore 204. As the switchable magnet 208 is used for both holding the ballast 210 and for attaching to the steel lining 216 in this example, the ballast 210 may be dropped at a depth somewhat below the target attachment point, such as 20 feet deeper, 10 feet deeper, or less.

The electronics package 206 then collects data over time, storing it in memory. At a designated measurement, such as after a set period of time, the electronics package 206 switches the switchable magnet 208 from the on state to the off state to release the UMT 200 from the steel lining 216, allowing the UMT 200 to return to the surface where it is recovered through the wellhead. The data collected is then downloaded from the UMT 200. In various embodiments, this is performed after the mission is completed, e.g., a target time is reached, or a low battery condition, extreme conditions that may lead to damage, the reaching of a target temperature, the reaching of a target pressure, or a memory full condition, among others.

In some embodiments, the case 202 is spherical to control the motion through the fluids of the wellbore 204. The case 202 may include weights to control the orientation of the UMT 200 as it ascends 214. For example, the weights may be used to orient the switchable magnet 208 to a horizontal position after the ballast 210 is dropped, improving the probability of attachment to the steel lining 216 after the switchable magnet 208 is switched to an on state. Other shapes and configurations may be used for the UMT 200, as described with respect to FIGS. 3A-3D and 4.

Figure 3A:
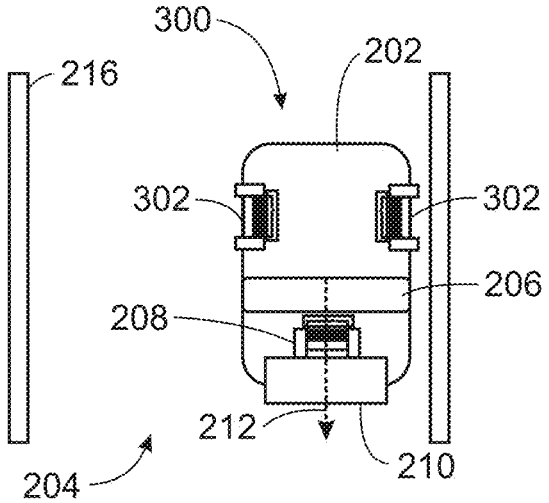
FIGS. 3A-3D are schematic diagrams of a cylindrical UMT in a wellbore.

FIGS. 3A-3D are schematic diagrams of a cylindrical UMT 300 in a wellbore 204. Like numbered items are as described with respect to FIGS. 2A, 2B, and 2C. In the embodiment illustrated by the cylindrical UMT 300, one or more additional switchable magnets 302 are located on the sides of the casing 202. The shape of the case 202 and the additional switchable magnets 302 allow for a number of different descent, ascent, and attachment patterns. For example, as shown in FIG. 3A, the cylindrical UMT 300 may descend 212 in the wellbore 204 while still having the additional switchable magnets 302 exposed.

Figure 3B:
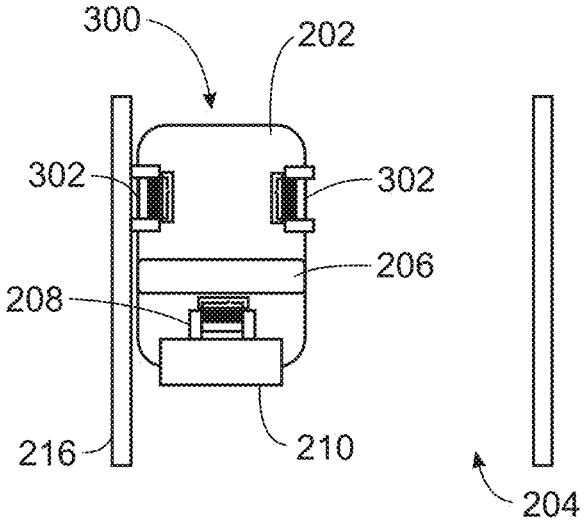
Figure 3C:
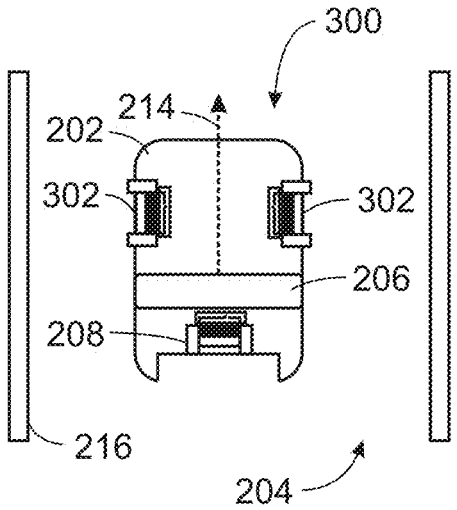

This allows the cylindrical UMT 300 to attach to the steel lining 216 of the casing or tubing during the descent, as shown in FIG. 3B. Generally, the selection of the weight of the ballast 210 may allow more precise control of the rate of the descent, than the rate of the ascent, which is controlled by the total density of the cylindrical UMT 300 in comparison to the fluids in the wellbore. Accordingly, the location of the attachment to the steel lining 216 may be more controllable.

Further, the drag on the cylindrical UMT 300 during the descent may be more controllable by recessing the ballast 210 as shown in FIGS. 3A and 3B. Even though the switchable magnet 208 is inset in the recess, blocking attachment to the steel lining 216, the additional switchable magnets 302, located on the sides of the casing 202, are available for coupling to the steel lining 216.

Figure 3D:
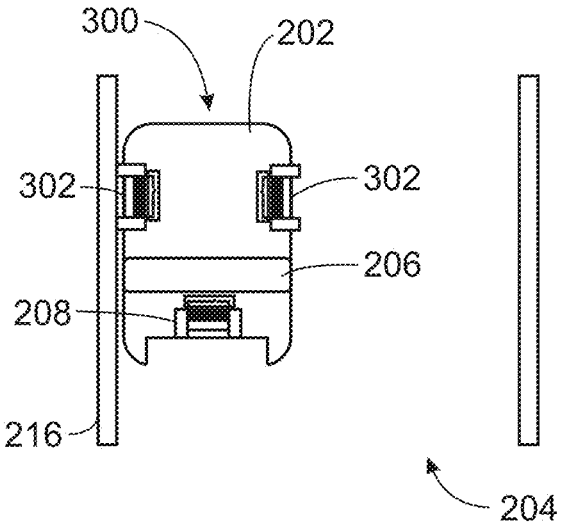

After dropping the ballast 210, the cylindrical UMT 300 ascends 214 in the wellbore 204. During the ascent, the additional switchable magnets 302 may be switched to allow the cylindrical UMT 300 to couple to the steel lining 216 of the wellbore 204, as shown in FIG. 3D.

In one embodiment, the ballast can be composed of dissolvable materials that can dissolve or disintegrate in the well fluids, such that the buoyancy change is controlled by the mass, geometry, and the dissolving rate of the ballast.

The tool design can be adjusted to make the side wall attachment easier and prevent sliding after attachment. For example, a streamline shape can be used to promote wall attachment during flow as described with respect to FIG. 4.

Figure 4:
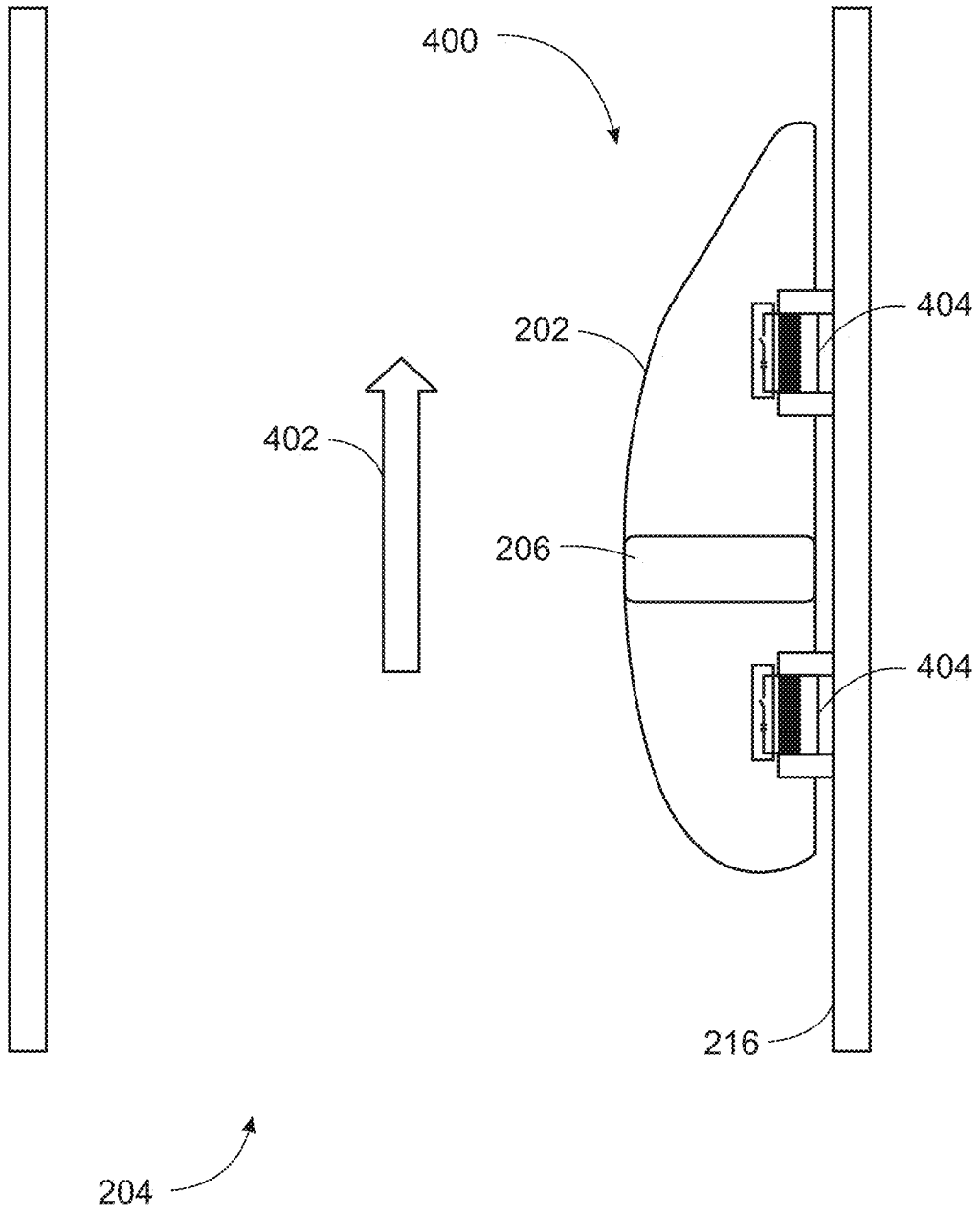
FIG. 4 is a schematic of a streamlined UMT in a wellbore.

FIG. 4 is a schematic of a streamlined UMT 400 in a wellbore 204. Like numbered items are as described with respect to FIGS. 2A-2C. The streamlined UMT 400 can be shaped to enhance the coupling to the steel lining 216, for example, to lower the drag from the flow 402 of fluids in the wellbore 204. In this embodiment, the streamlined UMT 400 has two switchable magnets 404 located on a lower surface of an aerodynamic shape. The streamlined UMT 400 may be deployed into the wellbore 204 with ballast attached to one or both of the switchable magnets 404. After dropping the ballast, the switchable magnets 404 are switched to couple the streamlined UMT 400 to the steel lining 216, casing or tubing, and the wellbore 204.

Various other designs that can be implemented to enhance the coupling to the steel lining 216. For example, in some embodiments, flaps are used to improve the attachment force further.

Figure 5A:
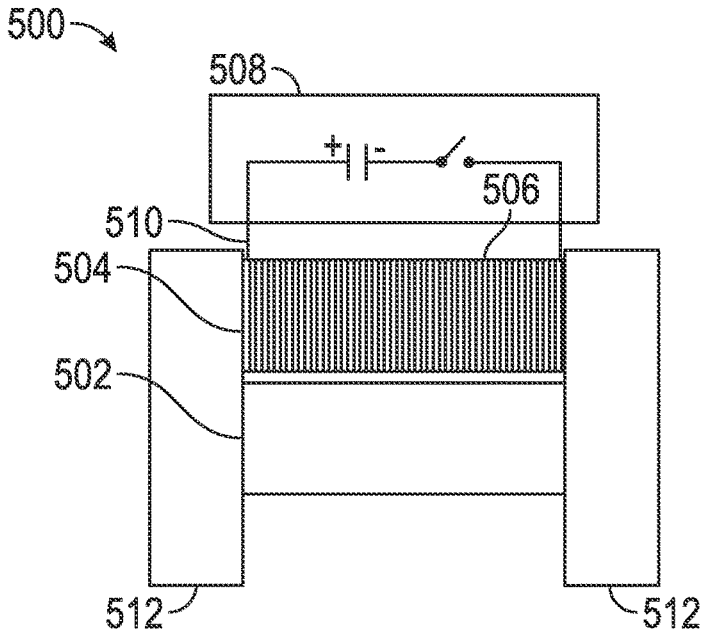
FIG. 5A is a cross-sectional diagram of a switchable magnet used to couple the untethered measurement tool to ferromagnetic surfaces.

FIG. 5A is a cross-sectional diagram of a switchable magnet 500 used to couple the untethered measurement tool to ferromagnetic surfaces. In some embodiments, the switchable magnet 500 includes two permanent magnets 502 and 504 connected in parallel. One of the permanent magnets 502 is made of a material that has a higher coercivity or resistance to having its magnetization direction reversed, for example, samarium cobalt (SmCo), among others. The second permanent magnet 504 is made of a material that has a lower coercivity or resistance to having its magnetization direction reversed, and therefore can have its polarization direction changed easily, for example, aluminum nickel cobalt (AlNiCo, Alnico V), among others. The size and material of the two permanent magnets 502 and 504 is selected so that they have essentially the same magnetic strength, i.e., remnant magnetization.

In one embodiment, a coil of wire 506 is wrapped around the lower coercivity magnet, i.e. the second permanent magnet 504, shown in the embodiment illustrated in FIG. 5A. In another embodiment, a coil may be wrapped around both magnets, since the higher coercivity magnet is chosen such that it will not be repolarized by the field produced by the coil of wire 506. In another embodiment, there are an even number of magnets, e.g., two, four, or more, all of the same low coercivity material (such as AlNiCo) and the same dimensions. The coil of wire 506 is wrapped around half of the magnets, such that only half of the magnets have polarization switched by the coil. Making all magnets of the same low coercivity material simplifies the matching of the magnetic strength of the repolarized and unrepolarized magnets. This helps to ensure field cancellation in the polarization or off state, as a failure to completely cancel the fields in the polarization state may result in a failure to decouple from a surface, such as the ballast.

Figure 6:
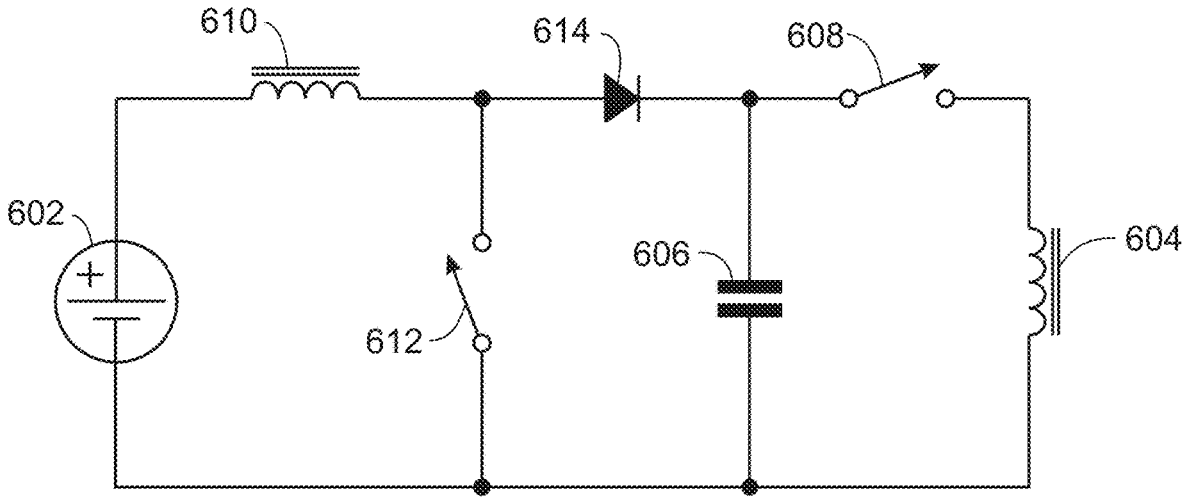
FIG. 6 is a schematic diagram of a boost circuit.
Figure 8:
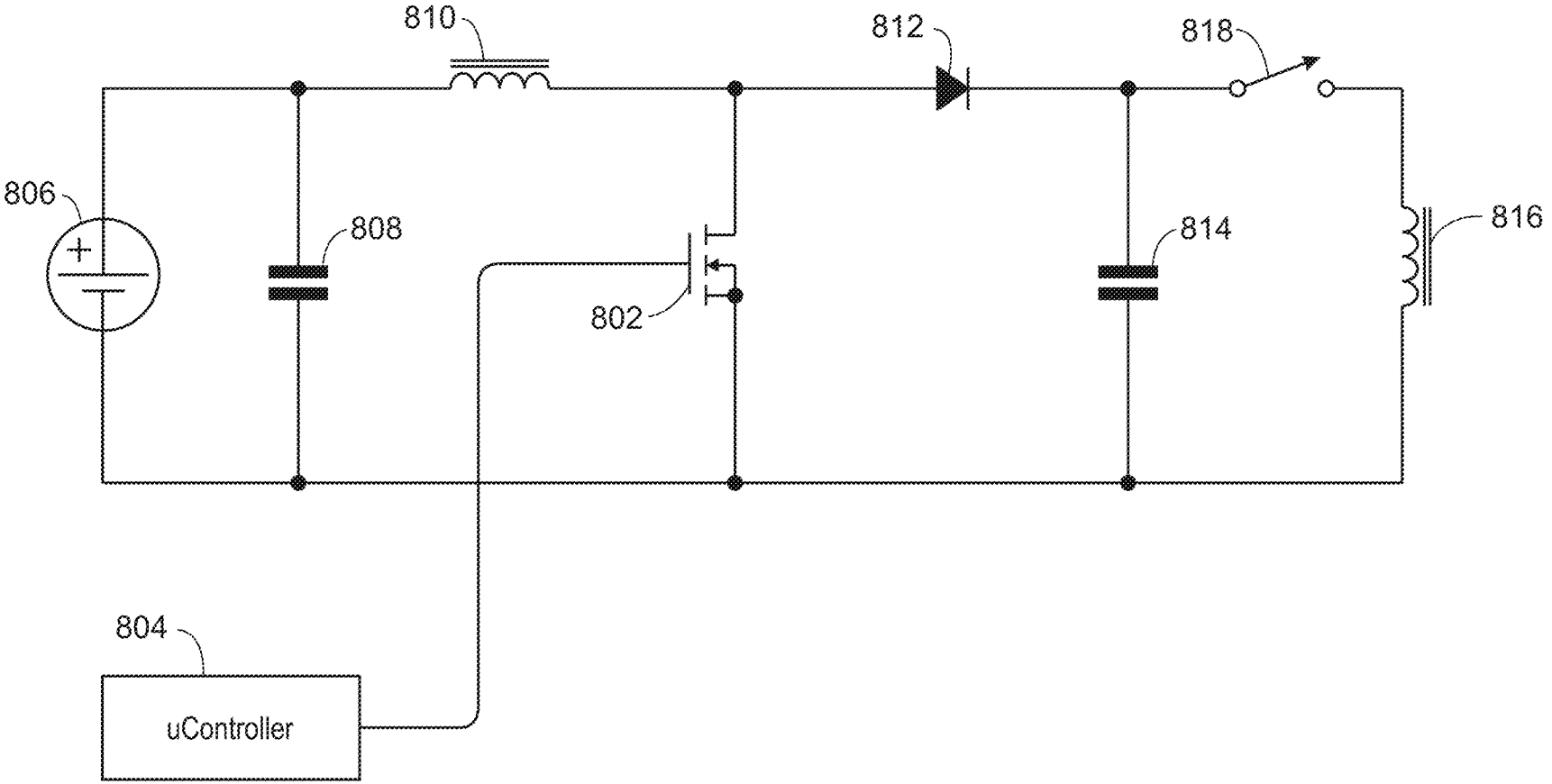
FIG. 8 is another example of a boost circuit that uses a switch with a modulated control signal from a controller.

As the battery may not provide the voltage and current needed to power the repolarization, a boost circuit 508, as described further with respect to FIGS. 6 and 8, provides the power to switch the switchable magnet 500 between an external flux or on state and an internal flux or off state. The power is provided from the boost circuit through leads 510 attached to the coil of wire 506. When a short pulse, or sequence of pulses, of a large electrical current is applied to the coil of wire 506 in a first direction, it permanently polarizes the lower coercivity magnet, e.g., the second permanent magnet 504. In some embodiments, the pulse or each of the pulses is about 200 microseconds in duration, at a current of about 20 amps. In an embodiment, this orients the flux lines in the same direction as the higher coercivity magnet, e.g., the first permanent magnet 502. This is described herein as the external flux or on state in which the magnetic flux lines run through flux channels 512, attached to the permanent magnets 502 and 504, to the outside of the untethered measurement tool. In some embodiments, the flux channels 512 are made of a material having a high magnetic permeability, such as iron. In the on state, a UMT can couple to a ferromagnetic surface, such as the ballast 210 or the steel lining of a wellbore.

A pulse or pulse sequence applied to the coil of wire 506 in a second direction reverses the polarization of the low coercivity magnet, e.g., the second permanent magnet 504, in the opposite direction from the high coercivity magnet, e.g., the first permanent magnet 502. This is described herein as the internal flux or off state, as the magnetic flux travels in a loop through the two permanent magnets 502 and 504 and through the flux channels 512, but does not substantially extend outside the untethered measurement tool. This allows the untethered device to decouple from a ferromagnetic surface, such as the ballast 210 or the steel lining of the casing, and ascend within the wellbore.

Figure 5B:
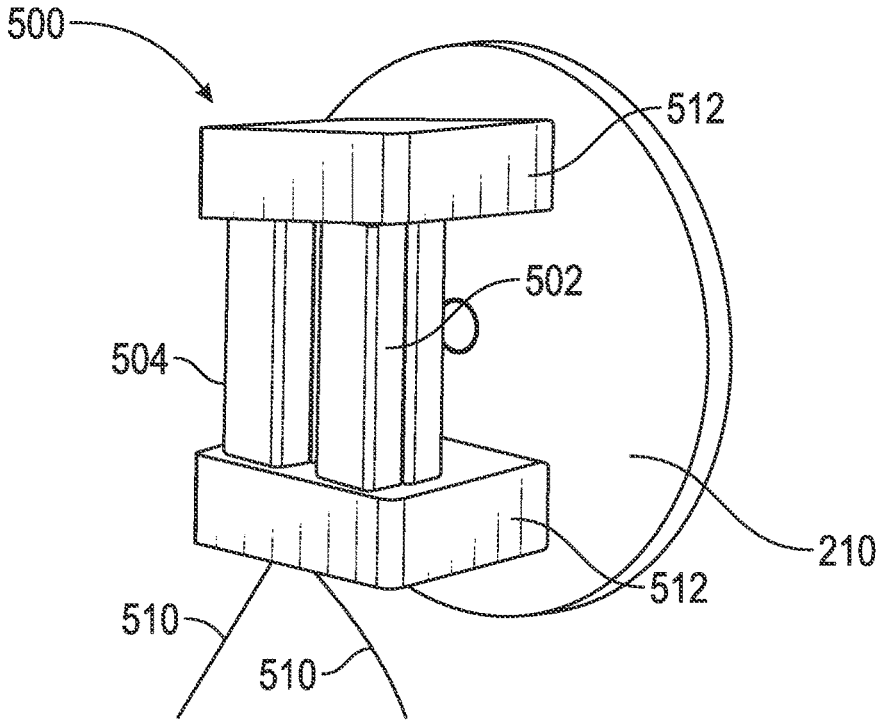
FIG. 5B is a drawing of the switchable magnet.

FIG. 5B is a drawing of the switchable magnet 500. In the drawing of FIG. 5B, the switchable magnet 500 is coupled to the ballast 210. The boost circuit 508 is not shown in FIG. 5B. Examples of circuits that may be used as the boost circuit 508 are discussed further with respect to FIGS. 6-11.

As described herein, the magnetic field amplitude needed to polarize a magnet depends on coercivity of the material. AlNiCo (aluminum-nickel-cobalt) magnets typically have lower coercivitiy relative to other common materials such as nickel-iron-boron (NIB) or SmCo. For grade-5 AlNiCo, the magnetic field amplitude exceeding 50 kA/m is needed to change the polarization direction. This corresponds to about 800 Ampere-turns for a magnet with 3/16" diameter and ½" length. This means, for example, that 20 A of current needs to be pushed along a coil with 40 turns wrapped around the AlNiCo magnet.

FIG. 6 is a schematic diagram of a boost circuit 600. Typically a small battery 602, e.g. less than 1 $cm^3$, used to power a miniaturized tool cannot supply more than a few milliamps of current, therefore, there is a need for amplification for powering the load or coil 604. For example, the boost circuit 600 can be used to charge a capacitor 606 of size several tens of microfarads to a relatively high voltage, e.g. in the range of 40-100 V. The stored charge can be released over the coil 604 to provide the desired current amplitude by triggering a switch 608. The size of the capacitor 606 and voltage charge level are selected based on the inductance of the coil 604 which is defined by the material of the magnet and the size of the magnet, e.g., radius, length, and the like, and the number of wire turns. For example, a 15 microFarad (μF) capacitor charged to 100 V can generate 20-25 A of current on a coil with 40 turns wrapped around an AlNiCo—V magnet with 3/16" diameter and a ½" length.

The boost circuit 600 has an inductor 610 that boosts the voltage and amperage as a switch 612, such as a power MOSFET, is sequentially turned on and off using a control signal. e.g., a pulse train, from the electronics package. A blocking diode 614 is used to force current to flow from the capacitor 606 through the coil 604 when the switch 612 is open.

Figure 7:
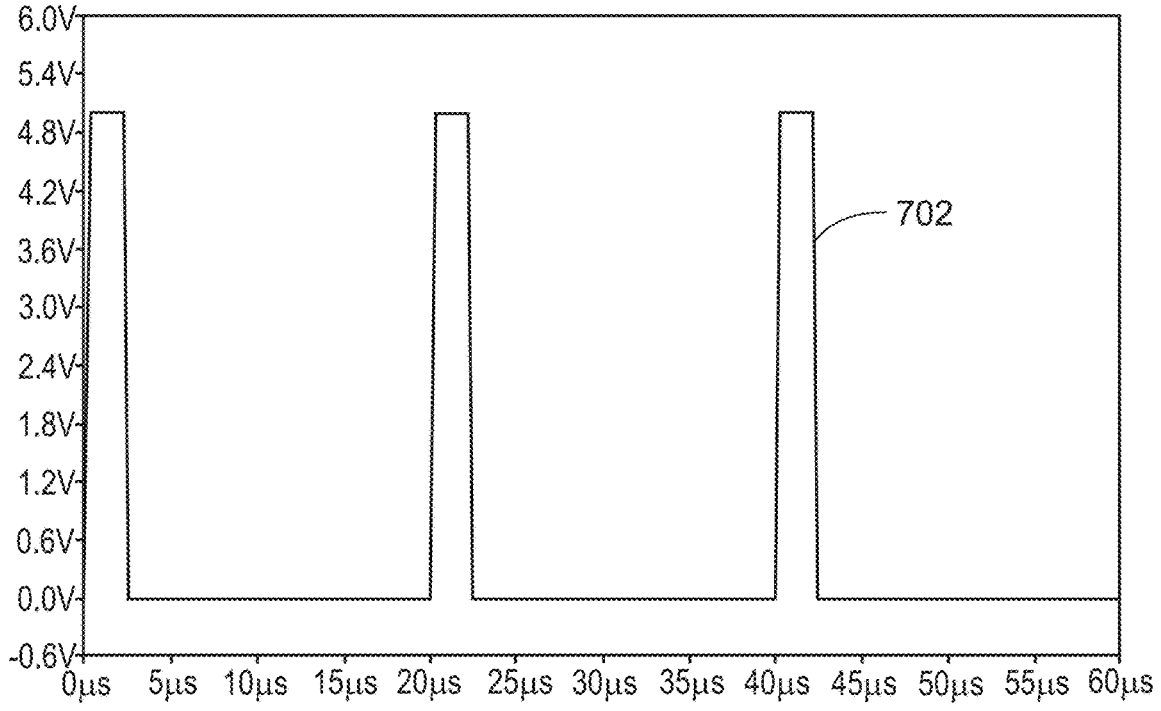
FIG. 7 is a plot of a pulse train that can be used as the control signal to the switch.

FIG. 7 is a plot 700 of a pulse train 702 that can be used as the control signal to the switch 612. Referring also to FIG. 6, the switch 612 is closed for 2 μs and opened 18 μs periodically. When switch 612 is closed, a large current is drawn through the inductor 610. As the switch is opened, the large current on the inductor 610 is pushed towards the capacitor 606, resulting in charge accumulation. This process is repeated until the desired voltage is reached at the capacitor 606, which flows through the coil 604 reversing, or enhancing, the polarity of the magnet.

FIG. 8 is another example of a boost circuit 800 that uses a switch 802 with a modulated control signal from a controller 804. Due to limited current supply of small size batteries, such as battery 806, to boost up voltages as high as 100 V for providing power may require additional strategies. In contrast to batteries, capacitors can supply large amount of currents for a short time. In one embodiment, an input capacitor 808, for example, with a capacitance of 300 μF, is placed in parallel with the battery 806. In this embodiment, the battery 806 supplies a small current and charges the input capacitor 808 over a relatively long time. The input capacitor 808 then supplies a larger current to the boost circuit 800 over a shorter time.

As for the boost circuit 600 of FIG. 6, the boost circuit 800 uses an inductor 810, a blocking diode 812, and an output capacitor 814 to provide a higher voltage to the load, e.g., coil 816, when a power switch 818 is closed. In this example, the inductor 810 has an inductance of about 6.8 microHenry (μH). The output capacitor 814 has a value of about 15 μF. The higher voltage output is generated by modulating a signal from the controller 804 to the switch 802, as discussed further with respect to FIG. 9. The controller 804 may be as described with respect to the controller 1302 of FIG. 13.

Figure 9:
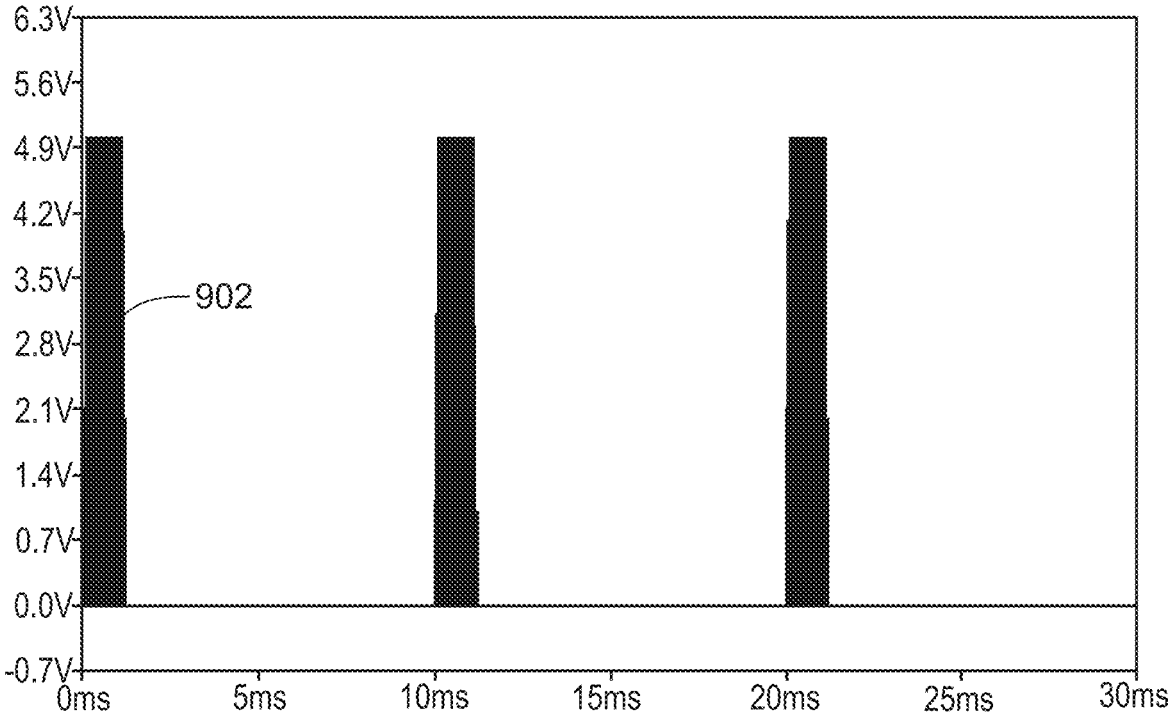
FIG. 9 is a plot of a modulated switch input signal that may be used with the circuit of FIG. 8.

FIG. 9 is a plot 902 of a modulated switch input signal that may be used with the boost circuit 800 of FIG. 8. Referring also to FIG. 8, the modulated control signal to the switch 802 allows the input capacitor 808 to be recharged once it has been depleted. For example, as shown in the plot 902, the switch 802 is periodically opened and closed at short periods for some time (e.g., closed 2 μs and opened 18 μs for 2 ms) for powering the boost circuit. During this time, the input capacitor 808 provides a relatively high current that cannot be directly sourced from the battery. Then, the switch 802 stays open for some time (e.g. 8 ms) to allow recharging the depleted input capacitor 808 from the battery 806. In other words, a first pulse train with a shorter period applied to the switch 802, is modulated with a second pulse train that has a longer period (e.g. 100 times longer than the first pulse train's period) in order to stop the boost circuit and allow recharging of the input capacitor 808.

Figure 10:
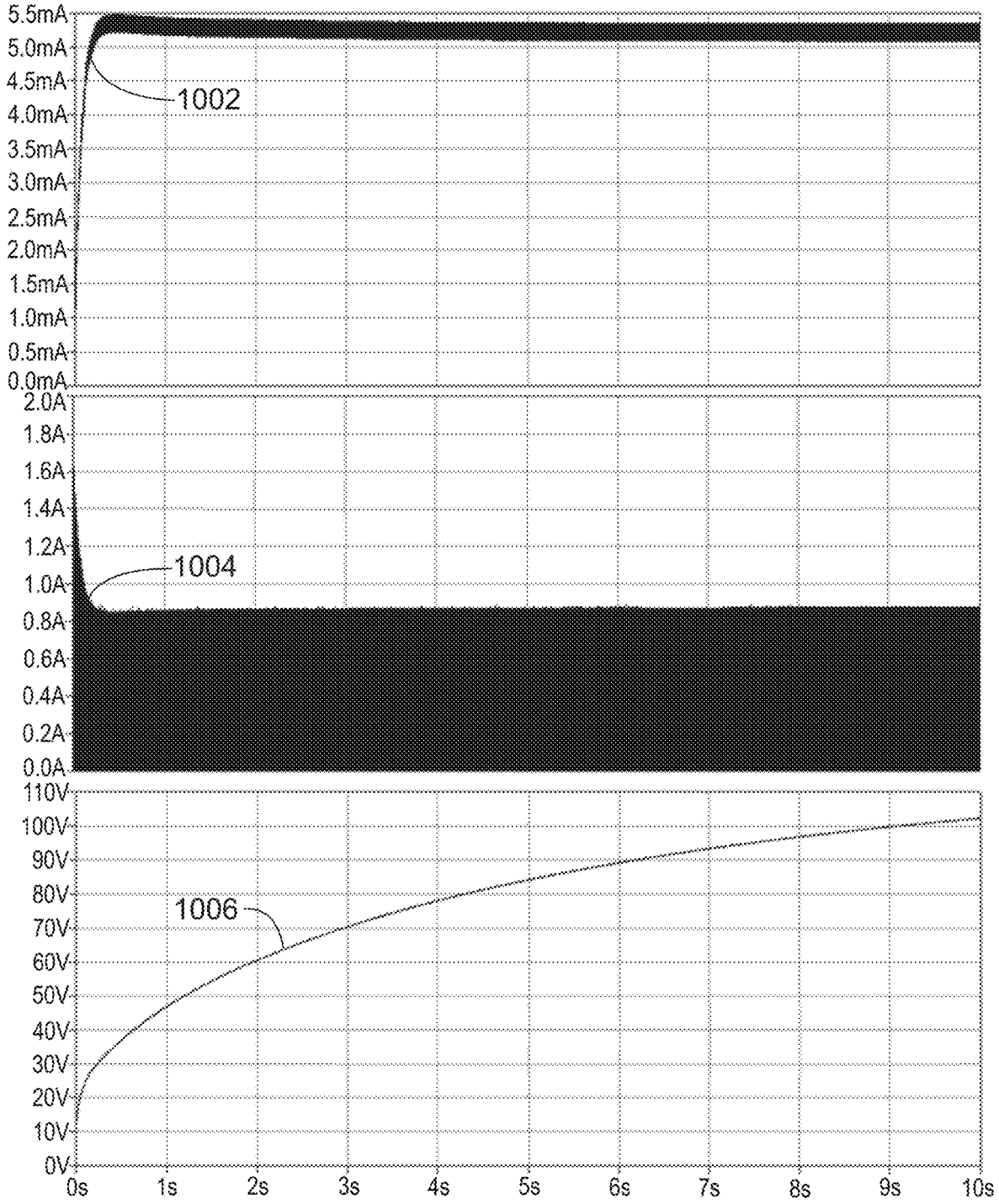
FIG. 10 is a plot of the currents present in the circuit of FIG. 8, using the control signal shown in FIG. 9.

FIG. 10 is a plot 1000 of the currents present in the circuit of FIG. 8, using the control signal shown in FIG. 9. Referring also to FIGS. 8 and 9, the plot 1000 shows the current 1002 pulled from the battery 806 during circuit operation, the current 1004 pulled from the input capacitor 808, and the voltage 1006 accumulated on the output capacitor 814, by using the modulated switch control signal. While the input capacitor 808 supplies current pulses that have an amplitude close to 1 A, the battery 806 continuously charges the input capacitor 808 with a smaller current, ~5 mA, due to its internal resistance. The plot 1000 shows that the accumulated voltage 1006 on the output capacitor 814 is about 100 V within about 10 s. An analog to digital converter (ADC) and a microcontroller can be used to detect the voltage on the output capacitor 814 and accordingly start or stop the switch control. The modulated switch input signal can be produced by a digital output channel of the controller 804.

As seen in FIG. 10, charging the output capacitor 814 to the desired voltage level may take up to 10 s. In various scenarios, less than 10 s may be desirable to change the state of the switchable magnet between the on state and the off state. For example, releasing the ballast and attaching to the casing wall may need to be established in a short interval.

For these cases, the output capacitor 814 can be charged ahead of time, and then discharged through the coil 816 when needed by closing the power switch 818. Capacitors have leakage current which eventually reduces the stored voltage. The voltage drop due to leakage can be compensated quickly when needed. For example, the output capacitor 814 can be fully charged right after the UMT is deployed in the wellbore. The controller 804 can regularly, e.g. every 5 minutes, check the voltage on the output capacitor 814. If the voltage is below a threshold value, it then activates the charging circuit to charge it to the desired voltage level. In another scenario, a depth estimator can be used to predict the arrival time. The depth estimator can work based on known logging speed and sensor outputs such as casing collar locator, pressure, acceleration, and time. For example, charging can be started 5 minutes before the estimated arrival time, and voltage drops until the arrival time due to leakage can be compensated as explained before.

Figure 11:
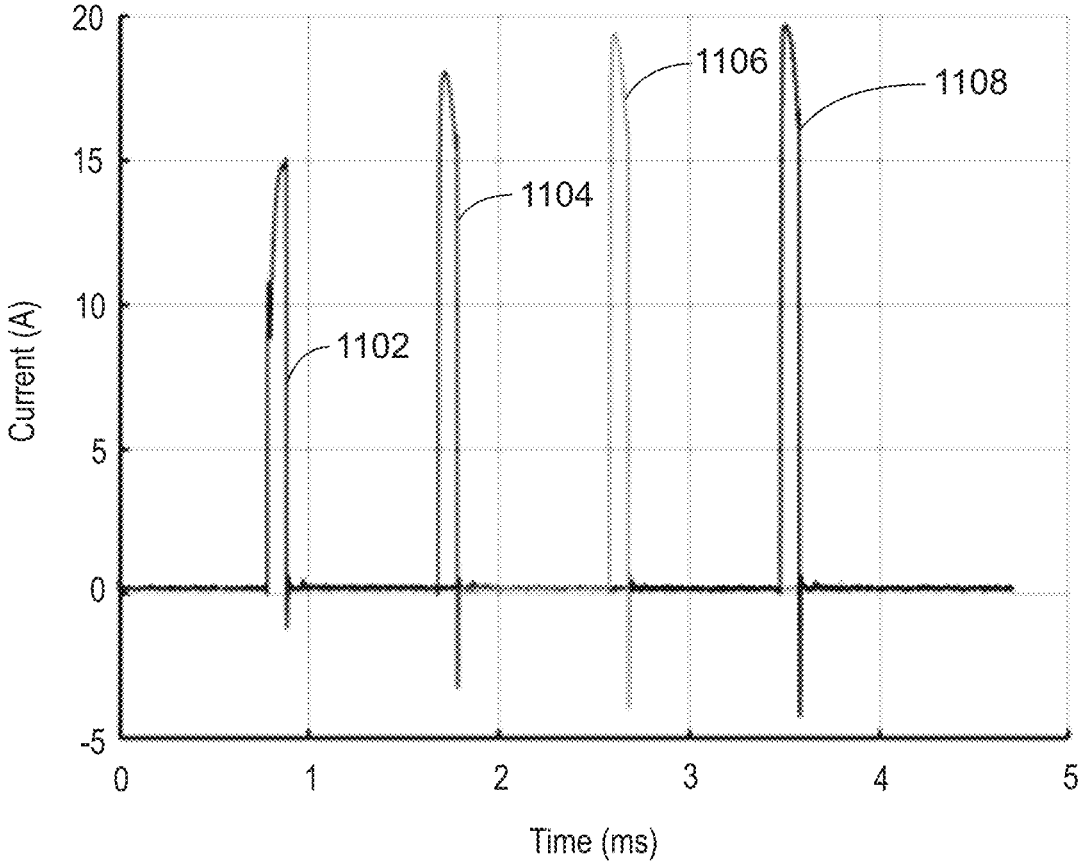
FIG. 11 is a plot of successively measured currents obtained by discharging a 100 μF capacitor charge to 48 V through a coil.

FIG. 11 is a plot 1100 of successively measured currents 1102-1108 obtained by discharging a 100 μF capacitor charged to 48 V through a coil. There may be limited space for a capacitor, and the voltage level may need to stay below a threshold value due to various reasons, such as shorting hazards. The switchable magnet may be repolarized by repeated charge and discharge cycles even if the magnet polarization does not reach full saturation in a single charge. For example, a 100 μF capacitor charged to 50 V and discharged through a coil with 40 turns wrapped around an AlNiCo—V magnet with 3/16" diameter and ½" length can only partially change the polarization. This is due to the nonlinearity of inductance changes from the magnetization state of the AlNiCo magnet. Inductance takes its maximum value when the magnet's residual B field is around 0 (when magnet is depolarized). As more discharge pulses are applied, coil inductance is reduced which allows more current to pass, and a larger magnetization is obtained. The current initially stays limited to 15 amps (A), but eventually reaches close to 20 A which provides a magnetization state near magnet saturation.

Figure 12:
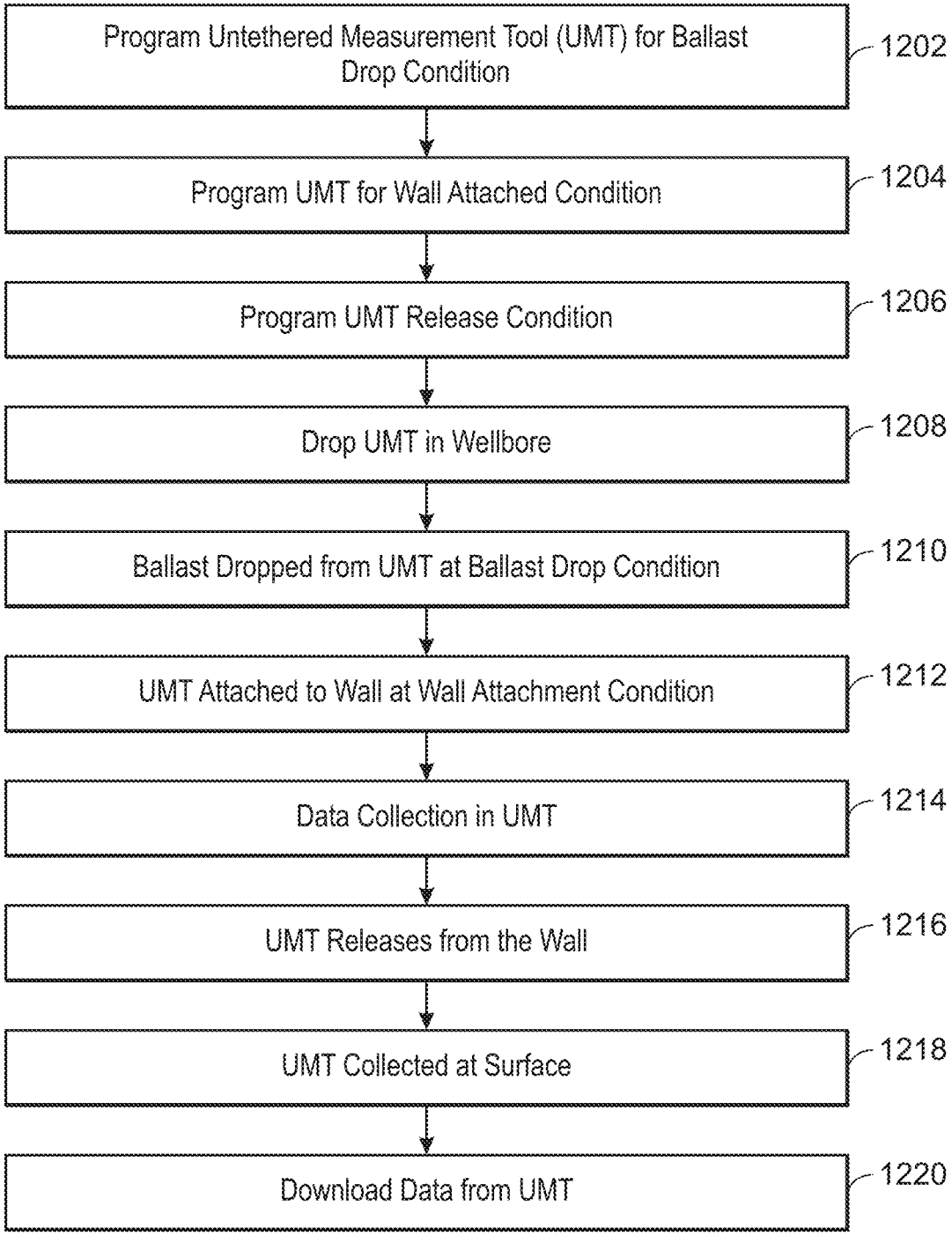
FIG. 12 is a process flow diagram of a method for using the untethered measurement unit in a semipermanent downhole configuration.

FIG. 12 is a process flow diagram of a method 1200 for using the untethered measurement unit in a semipermanent downhole configuration. The method begins at block 1202 when the untethered measurement tool (UMT) is programmed with a ballast drop condition. In some embodiments, the depth is estimated based at least in part, on casing collar counts provided by a casing collar locator. In some embodiments, the ballast drop condition is based, at least in part, on a pressure measurement. The pressure measurement may provide a proxy measurement for depth. For example, the UMT may drop the ballast when the pressure reaches 100 psi over the surface pressure, 200 psi over the surface pressure, or higher. In some embodiments, the ballast drop condition is based, at least in part, on a time measurement. The rate that the UMT descends in the wellbore, based on buoyancy, ballast weight, fluid density, and the like, may be calculated. Accordingly, a time measurement may be used as a proxy for depth. For example, the UMT may drop the ballast after 300 seconds (s), 600 s, 1200 s, or higher. In some embodiments, the ballast is dropped if the charge on the battery drops below a set point, such as a 50% charge, 20% charge, a 10% charge, or lower.

At block 1204, the UMT is programmed with a wall attachment condition. In some embodiments, the wall attachment condition is based, at least in part, on depth. For example, when the UMT reaches a target depth, either during an ascent after the ballast is dropped or during the descent before the ballast is dropped, a switchable magnet may be switched to attach the UMT to the wall of the wellbore. In some embodiments, immediately after the switchable magnet is switched to the off state, dropping the ballast, the switchable magnet is switched back to the on state, allowing the UMT to attach to the wall of the wellbore. In other embodiments, a second magnet is used for wall attachment, and is activated either after the ballast is dropped by switching the first magnet to an off state, or before the ballast is dropped, or the two events can occur simultaneously.

At block 1206, the UMT is programmed with a release condition to trigger the release of the UMT from the wall. In some embodiments, the release condition is based on a time measurement, for example, allowing the UMT to collect data for a set period of time before releasing from the wall. After attachment, the UMT may collect data for 5 minutes (min.), 10 min., 20 min., 60 min., or longer, after which the switchable magnet is switched to the off state and the UMT resumes and assent or a descent, for example, if the ballast has not been dropped. This provides for the possibility of more complex data collection programs for the UMT, for example, with the UMT attaching to the wall at several points along a descent to collect data, and then releasing from the wall, dropping the ballast, and ascending. Similarly, a complex program may allow attaching and release of the UMT and data collection at several locations during ascending after the ballast is dropped. In some embodiments, the UMT is detached from the wall if the charge on the battery drops below a set point, such as a 50% charge, 20% charge, a 10% charge, or lower. In these embodiments, the ballast is also dropped, if it has not already been dropped. In some embodiments, the UMT is detached from the wall after a data memory is filled.

At block 1208, the UMT is dropped in the wellbore. In some embodiments, this is done by opening the top of the wellbore to allow access. In other embodiments, the UMT is inserted into the wellbore through a pressure port, such as through two valves in series at the top of the wellbore.

At block 1210, the ballast is dropped from the UMT at the ballast drop condition. This is performed at the ballast drop condition as described with respect to block 1202.

At block 1212, the UMT is attached to the wall at the wall attachment condition. This is performed at the wall attachment condition as described with respect to block 1204.

At block 1214, the UMT collects data on conditions in the well, such as pressure, temperature, composition, and the like. The data may be collected using the same sensors as used for determining release and attachment conditions. In some embodiments, a sampling vessel is included in the UMT to collect a sample at the attachment point. The sampling vessel may be a small vessel fluidically coupled to the external surface of the UMT through a port. The vessel is evacuated before the UMT is inserted in the wellbore. A solenoid valve between the evacuated vessel and the port may be opened after attachment to collect the sample, for example, during data collection, then close to capture the sample. The buoyancy of the UMT may be adjusted to account for the weight of the vessel and the sample. The sample is used to provide information on the composition of the fluids in the wellbore, such as ratios of oil, gas, and water in the fluids, or composition information on the hydrocarbons captured.

In some embodiments, the UMT carries a corrosion coupon whose weight is measured before the deployment and after the retrieval of the UMT to determine the corrosion rate at the target depth. In some embodiments, the UMT carries a resistive corrosion coupon and logs the resistance over time where the change in the resistance indicates the corrosion rate. In some embodiments, the UMT has recessed magnets to collect ferrous corrosion products. These magnets can be the same magnets where the ballast is attached.

In some embodiments, the UMT has a casing thickness sensor. This sensor can work based on various principles, for example measuring time of flight of a sound wave that is reflected from the inner and outer surfaces of a casing wall.

In some embodiments, the UMT has a hydrogen gas sensor.

In some embodiments, the UMT carries a hydrophone, or a geophone to record seismic data where a source emits seismic waves from the surface or from another location within the same or another well.

In some embodiments, the UMT has a flow sensor that can measure the fluid flow rate while attached on the casing wall. In one embodiment, the flow sensor may be based on a propeller attached to the UMT. In one embodiment, the flow sensor may be based on a strain sensor attached to a flap extending from the UMT. In one embodiment, the flow sensor may be based on a strain sensor attached on a flexible body that connects wall attachment magnets to the rest of the UMT body.

In some embodiments, the UMT measures viscosity and density while attached to the casing wall. The viscosity and density sensor can be comprised of a vibrating sensor, such as a tuning fork sensor.

In some embodiments, the UMT detects the phases of the flowing fluid while attached to the casing wall. The fluid phase sensor can be based on a dielectric sensor or an optical refractive index sensor.

At block 1216, the UMT releases from the wall, and ascends in the well. This is performed at the wall release condition as described with respect to block 1206.

In various embodiments, the order of events in the blocks 1210-1216 can be changed, and some of the events may be recursive based on the program provided in the blocks 1202-1206. For example, the wall attachment of block 1212 can happen before the ballast dropping condition of block 1210; or the program can activate another wall attachment event 1212, after the UMT is released from the casing wall 1216.

At block 1218, the UMT is collected at the surface from the wellbore. For example, if surface equipment have been moved to allow access to the top of the wellbore, the UMT is removed from the fluids at the top of the wellbore. If the UMT was dropped through a pressure port, time, sounds at the top of the wellbore, or other indications may be used to determine that the UMT has returned to the lower valve of the pressure port. The lower valve may be opened to allow the UMT to move between the 2 valves of the pressure port, before closing the lower valve and opening the upper valve to remove the UMT.

At block 1220, data from the UMT is downloaded. Further, any samples captured by the UMT are removed, for example, under pressure to maintain gas portions of the samples. The data from the UMT may be downloaded through a wired connection, such as a USB port, a serial port for instrumentation, and the like. In some embodiments, the data from the UMT is downloaded through a wireless communications loop in the UMT. In some embodiments, the battery in the UMT is charged through the wireless communications loop.

Figure 13:
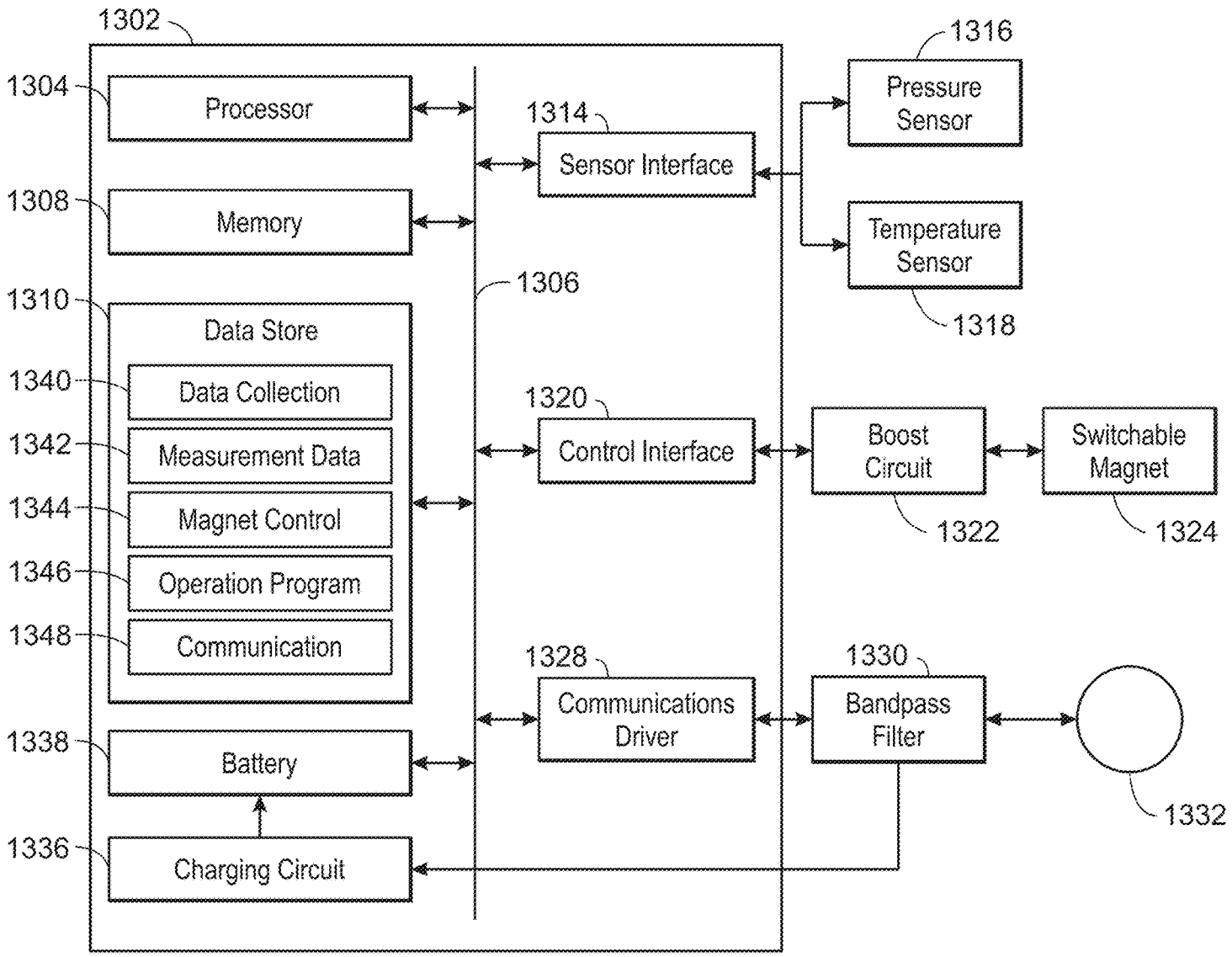
FIG. 13 is a block diagram of an untethered measurement tool (UMT).

FIG. 13 is a block diagram of an untethered measurement tool (UMT) 1300. To implement operations, the UMT 1300 includes a controller 1302 that includes a processor 1304. The processor 1304 may be a microprocessor, a multi-core processor, a multithreaded processor, an ultra-low-voltage processor, or an embedded processor. In some embodiments, the processor 1304 may be part of a system-on-a-chip (SoC) in which the processor 1304 and the other components of the controller 1302 are formed into a single integrated electronics package. In various embodiments, the processor 1304 may include processors from Intel® Corporation of Santa Clara, Calif., from Advanced Micro Devices, Inc. (AMD) of Sunnyvale, Calif., or from ARM Holdings, LTD., Of Cambridge, England. Any number of other processors from other suppliers may also be used.

The processor 1304 may communicate with other components of the controller 1302 over a bus 1306. The bus 1306 may include any number of technologies, such as industry standard architecture (ISA), extended ISA (EISA), peripheral component interconnect (PCI), peripheral component interconnect extended (PCIx), PCI express (PCIe), or any number of other technologies. The bus 1306 may be a proprietary bus, for example, used in an SoC based system. Other bus technologies may be used, in addition to, or instead of, the technologies above.

The bus 1306 may couple the processor 1304 to a memory 1308. In some embodiments, such as in microcontrollers, programmable logic controllers, and the like, the memory 1308 is integrated with a data store 1310 used for long-term storage of programs and data. The memory 1308 include any number of volatile and nonvolatile memory devices, such as volatile random-access memory (RAM), static random-access memory (SRAM), flash memory, and the like. In smaller devices, such as microcontrollers, the memory 1308 may include registers associated with the processor 1304 itself. The data store 1310 is used for the persistent storage of information, such as data, applications, operating systems, and so forth. The data store 1310 may be a nonvolatile RAM, a solid-state disk drive, or a flash drive, among others. 1306

The bus 1306 couples the processor 1304 to a sensor interface 1314. The sensor interface 1314 connects the controller 1302 to the sensors used to measure data in the UMT 1300. In some embodiments, the sensor interface 1314 is a bank of analog-to-digital converters (ADCs), an $I^2C$ bus, or a serial peripheral interface (SPI) bus, among others. In some embodiments, such as that shown in FIG. 13, the sensors include a pressure sensor 1316 and a temperature sensor 1318. In some embodiments, the pressure sensor is a Wheatstone bridge using carbon film resistors on two legs and metal film resistors on the opposite two legs. As carbon film resistors change resistance when pressure changes, the pressure is measured as the difference in resistance between the two legs. In some embodiments, the temperature sensor is a thermocouple.

Any number of other types of sensors may be used to measure temperature and pressure, such as microelectromechanical system (MEMS) sensors. Furthermore, any number of other sensors may be utilized, including optical sensors, electrical field sensors, vibration sensors, and the like.

The bus 1306 couples the processor 1304 to a control interface 1320 that is used to control the boost circuit 1322 for powering the repolarization of the switchable magnet 1324. In some embodiments, the control interface 1320 is a bank of relays, or a bank of MOSFET power controllers, among others. The control interface 1320 may also include an ADC to monitor the voltage on the output capacitor, Cout, which is part of the boost circuit 1322. The control interface 1320 can provide power and the control signal, or control signals, to the boost circuit 1322, which may be as described with respect to the boost circuits 600 and 800 of FIGS. 6 and 8. The switchable magnet 1324 is as described with respect to FIGS. 5A and 5B.

The bus 1306 couples the processor 1304 to a communications driver 1328. In some embodiments, the communications driver is a digital interface, such as an SPI bus, and $I^2B$ bus, or a digital bit interface that powers a RFI transceiver. In the embodiment shown in FIG. 13, the communications driver 1328 couples to a bandpass filter 1330. The bandpass filter 1330 is coupled to a radio loop antenna 1332. The radio loop antenna 1332 may include, for example, a coil, planar spiral antenna, or a helical antenna. The bandpass filter 1330 may couple higher frequencies signals, such as greater than about 50 kHz, 100 kHz, or higher, between the communications driver 1328 and the radio loop antenna 1332. The radio loop antenna 1332 can be used to wirelessly program the UMT 1300 and to transfer stored data from the UMT 1300 to an interrogator. Lower frequency signals, such as one kHz, 500 Hz, or 100 Hz, or lower, may be directed by the bandpass filter 1330 to a charging circuit 1336 to wirelessly charge a battery 1338.

Although the communications for the UMT 1300 are shown as radiofrequency communications through a radio loop antenna 1332, it may be understood that other communications techniques may be used. In some embodiments, the communications driver is a serial interface, for example, USB, SPI, or I2C, among others. In these embodiments, the bandpass filter 1330 is replaced with a hardware plug, for example, that is waterproof, or protected with a cover. In some embodiments, the communications driver is an optical transceiver, and the bandpass filter 1330 is replaced with a paired phototransistor and light emitting diode (LED). In these embodiments, a charging antenna may be used to charge the battery, for example, coupled directly to the charging circuit 1336.

The data store 1310 includes blocks of stored instructions that, when executed, direct the processor 1304 to implement the functions of the controller 1302. The data store 1310 includes a block 1340 of instructions to direct the processor to collect data from the sensors 1316 and 1318 and store the data collected in a block dedicated for data storage 1342.

The data store 1310 includes a block 1344 of instructions to direct the processor 1304 to change the state of the switchable magnet 1324 between the on state and the off state. For example, the instructions may direct the processor 1304 to monitor the voltage on the output capacitor for the boost circuit, and maintain the charge at sufficient levels to repolarize one of the magnets in the switchable magnet 1324.

The data store 1310 also includes a block of instructions to direct the processor 1304 to implement an operational program 1346 while the UMT 1300 is in the wellbore. The operational program may include the processes described with respect to FIG. 12.

The data store 1310 includes a block 1348 of instructions to direct the processor 1304 to communicate through the communications driver 1328 and the radio loop antenna 1332 with an external computer. The instructions may direct the processor to store instructions provided to the UMT 1300 as the operational program 1346 and to download data from the data store 1342 to the external computer.

EXAMPLE

Figure 14:
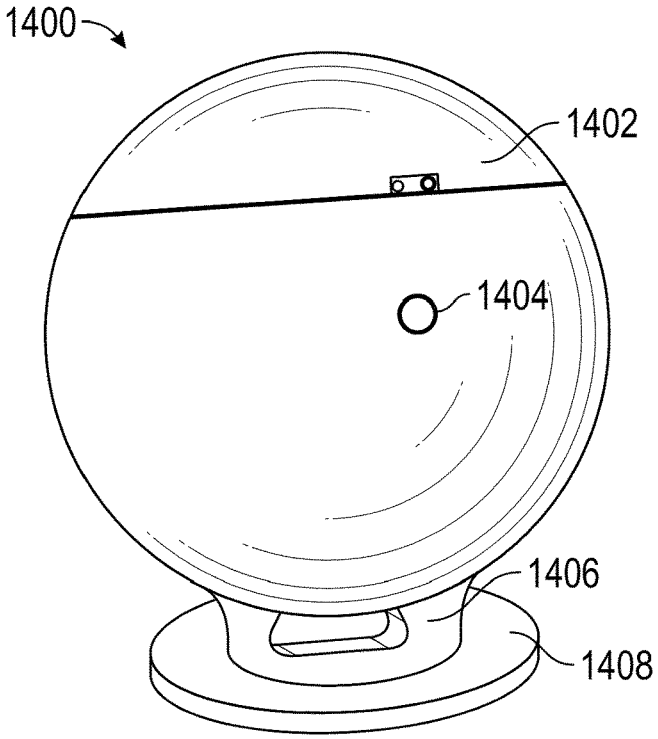
FIG. 14 is a drawing of a UMT that has been tested for collecting fixed point measurements in a wellbore.

FIG. 14 is a drawing of a UMT 1400 that has been tested for collecting fixed point measurements in a wellbore. The UMT 1400 has a buoyant housing 1402 that houses a controller with an internal memory. The UMT 1400 also has a temperature sensor 1404, and a switchable magnet 1406. The UMT 1400 is shown attached to a ballast plate 1408.

The UMT 1400 was dropped in a 3000 feet unpressurized water well and it returned about an hour later after the deployment. The temperature data stored in the tool was downloaded, providing the plot shown in FIG. 15.

Figure 15:
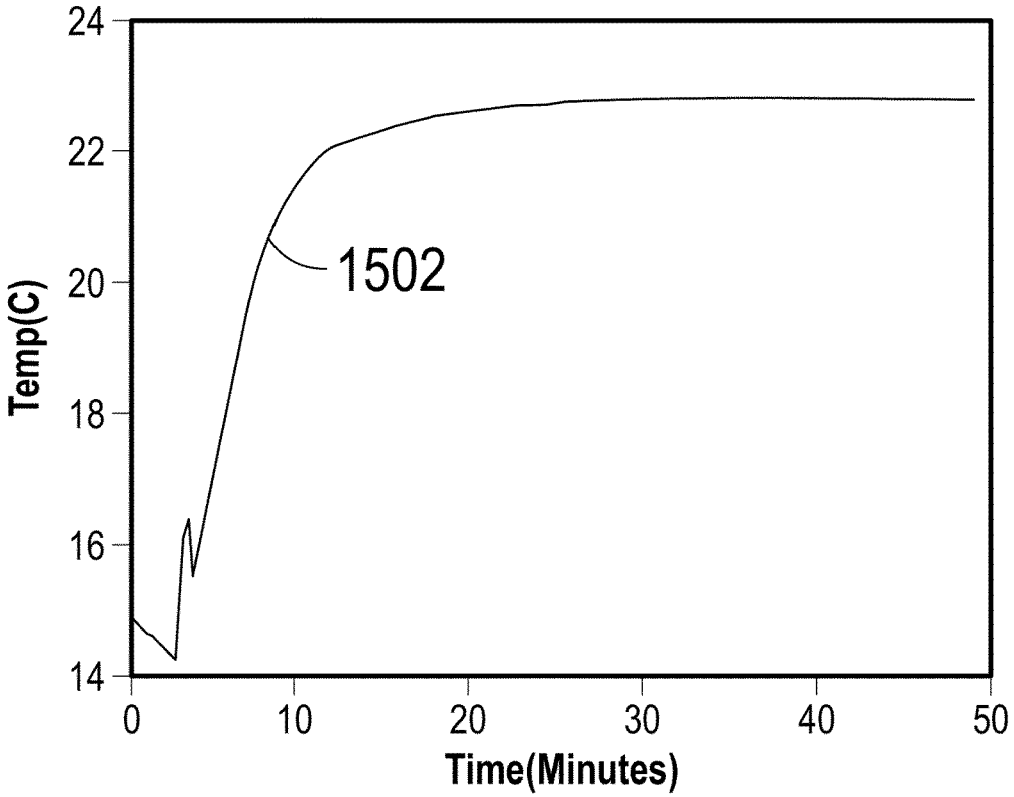
FIG. 15 is a plot of temperature versus time collected by the UMT 1400 at a fixed point in a wellbore.

FIG. 15 is a plot 1502 of temperature versus time collected by the UMT 1400 at a fixed point in a wellbore. The temperature rose from around 14° C. to 22° C. in the first ten minutes and then plateaued around 23° C. Temperature increases due to geothermal gradient and a constant temperature means the UMT 1400 is not traveling further down in the well. With an average travel speed in the range of 0.5-1 ft./sec, the data suggests that the tool traveled down to a depth within the range of 300-600 ft., dropped its weight, attached on the casing wall, stayed there until its memory was full. The UMT 1400 then switched the state of the magnet to the off state to detach from the wall and ascended to the surface.

EMBODIMENTS

An embodiment described in examples herein provides an untethered measurement tool (UMT) for logging data at a fixed location in a wellbore. The untethered measurement tool including a housing, wherein the housing is formed from a material that is buoyant in fluids in the wellbore. The UMT includes an unpowered magnet that is switchable between an external field state and a circular field state, wherein the external field state couples the untethered measurement tool to a ferromagnetic surface, and a power boost circuit to charge a capacitor to switch a state of the unpowered magnet. The UMT also includes a sensor configured to measure data in the wellbore and a controller. The controller includes a processor and a storage medium. The storage medium includes instructions to direct the processor to measure data correlating to a depth in the wellbore and switch the unpowered magnet to the circular field state at a target depth, dropping an attached ballast. The storage medium includes instructions to direct the processor to switch the unpowered magnet to the external field state, coupling the untethered measurement tool to a wall of the wellbore, log data from the sensor in the storage medium, and switch the unpowered magnet to the circular field state to release the untethered measurement tool.

In an aspect, the UMT includes a casing collar locator to collect data correlating to the depth. In an aspect, the UMT includes a pressure sensor to collect data correlating to the depth. In an aspect, the the pressure sensor includes a Wheatstone bridge using carbon film resistors on two legs and metal film resistors on an opposite two legs.

In an aspect, the UMT includes a corrosion coupon. In an aspect, the UMT includes a resistive corrosion coupon. In an aspect, the UMT includes recessed magnets to collect ferrous corrosion products. In an aspect, the UMT includes a casing thickness sensor. In an aspect, the UMT includes a hydrogen gas sensor. In an aspect, the UMT includes a seismic sensor. In an aspect, the UMT includes a flow sensor that can measure a fluid flow rate while attached on the wall of the wellbore. In an aspect, the UMT includes a viscosity and density sensor. In an aspect, the UMT includes a fluid phase sensor. In an aspect, the UMT includes a communication device to communicate with the untethered measurement tool outside of the wellbore. In an aspect, the communication device includes an optical transceiver. In an aspect, the communication device includes a radio loop.

In an aspect, the storage medium includes code to direct the processor to accept instructions through the communication device. In an aspect, the storage medium includes code to direct the processor to download logged data through the communication device.

Another embodiment described in examples herein provides a method for collecting data at a fixed point in a wellbore. The method includes dropping an untethered measurement tool (UMT) in the wellbore, switching a first magnet to drop a ballast from the UMT at a ballast drop condition, and switching a second magnet to attach the UMT to a wall of the wellbore at a wall attachment condition. The method includes collecting data in the UMT while the UMT is attached to the wall of the wellbore, and switching the second magnet to release the UMT from the wall of the wellbore at a wall release condition. The method also includes collecting the UMT from the wellbore and downloading the data from the UMT.

In an aspect, the first magnet and the second magnet are the same.

In an aspect, the method includes programming the ballast drop condition to be based, at least in part, on a depth measurement. In an aspect, the method includes programming the ballast drop condition to be based, at least in part, on a time measurement. In an aspect, the method includes switching a magnet to drop the ballast includes changing a polarity of a field of a first permanent magnet to cancel the field of a second permanent magnet. In an aspect, the method includes programming the wall attachment condition to be based, at least in part, on a depth measurement.

In an aspect, the method includes using a dissolvable ballast to change the buoyancy of the UMT from negative to positive.

In an aspect, the method includes switching a magnet to attach the UMT to the wall of the wellbore includes changing a polarity of a field of a first permanent magnet to align with the field of a second permanent magnet.

In an aspect, the method includes collecting temperature data while the UMT is attached to the wall of the wellbore. In an aspect, the method includes collecting pressure data while the UMT is attached to the wall of the wellbore. In an aspect, the method includes collecting composition data while the UMT is attached to the wall of the wellbore. In an aspect, the method includes collecting seismic data while the UMT is attached to the wall of the wellbore. In an aspect, the method includes collecting corrosion rate based on a coupon resistivity measurement while the UMT is attached to the wall of the wellbore. In an aspect, the method includes collecting density and viscosity data while the UMT is attached to the wall of the wellbore. In an aspect, the method includes collecting casing wall thickness data while the UMT is attached to the wall of the wellbore. In an aspect, the method includes collecting flow rate data while the UMT is attached to the wall of the wellbore. In an aspect, the method includes collecting fluid phase data while the UMT is attached to the wall of the wellbore.

In an aspect, the method includes preprogramming the wall release condition to be based, at least in part, on a time measurement. In an aspect, the method includes switching the second magnet to release the UMT from the wall of the wellbore when a charge on a battery reaches a determined set point. In an aspect, the determined set point is less than 20%.

Other implementations are also within the scope of the following claims.

What is claimed is:

1. An untethered measurement tool (UMT) for logging data at a fixed location in a wellbore, the UMT comprising:

a housing comprising weights to control orientation of the UMT, wherein the housing is formed from a material that is buoyant in fluids in the wellbore;

an unpowered magnet that is switchable between an external field state and a circular field state, wherein the external field state couples the UMT to a ferromagnetic surface;

a power boost circuit to charge a capacitor to switch a state of the unpowered magnet;

a sensor configured to measure data in the wellbore; and a controller, comprising:

a processor; and a non-transitory storage medium, wherein the non-transitory storage medium comprises instructions to direct the processor to:

measure data correlating to a depth in the wellbore;

switch the unpowered magnet to the circular field state at a target depth, dropping an attached ballast;

switch the unpowered magnet to the external field state, coupling the UMT to a wall of the wellbore;

log data from the sensor to the storage medium; and switch the unpowered magnet to the circular field state to release the UMT, wherein the weights cause the UMT to change from a first orientation to a second orientation in response to dropping the attached ballast, wherein the first orientation directs the unpowered magnet toward a downhole direction during descent of the UMT in the wellbore, and wherein the second orientation directs the unpowered magnet toward a horizontal direction during ascent of the UMT in the wellbore to facilitate coupling the UMT to the wall of the wellbore.

2. The UMT of claim 1, comprising a pressure sensor to collect data correlating to the depth.

3. The UMT of claim 1, comprising a casing thickness sensor.

4. The UMT of claim 1, comprising a hydrogen gas sensor.

5. The UMT of claim 1, comprising a seismic sensor.

6. The UMT of claim 1, comprising a flow sensor that can measure a fluid flow rate while attached on the wall of the wellbore.

7. The UMT of claim 1, comprising a viscosity and density sensor.

8. The UMT of claim 1, comprising a fluid phase sensor.

9. The UMT of claim 1, comprising a communication device to communicate with the untethered measurement tool outside of the wellbore.

10. The UMT of claim 9, wherein the communication device comprises an optical transceiver.

11. The UMT of claim 9, wherein the communication device comprises a radio loop.

12. The UMT of claim 9, wherein the storage medium comprises code to direct the processor to accept instructions through the communication device.

13. The UMT of claim 9, wherein the storage medium comprises code to direct the processor to download logged data through the communication device.

14. A method for collecting data at a fixed point in a wellbore, comprising:

attaching a ballast in a recess of an untethered measurement tool (UMT) via a first magnet;

dropping the UMT in the wellbore, wherein recessing the ballast facilitates controlling a drag on the UMT during descent and blocks attachment of the first magnet to a wall of the wellbore;

switching the first magnet to drop the ballast from the UMT at a ballast drop condition;

switching a second magnet separate from and perpendicular to the first magnet to attach the UMT to the wall of the wellbore at a wall attachment condition;

collecting data in the UMT while the UMT is attached to the wall of the wellbore;

switching the second magnet to release the UMT from the wall of the wellbore at a wall release condition;

collecting the UMT from the wellbore; and downloading the data from the UMT.

15. The method of claim 14, wherein the first magnet and the second magnet are the same type of magnet.

16. The method of claim 14, comprising programming the ballast drop condition to be based, at least in part, on a depth measurement.

17. The method of claim 14, comprising programming the ballast drop condition to be based, at least in part, on a time measurement.

18. The method of claim 14, wherein switching a magnet to drop the ballast comprises changing a polarity of a field of the first magnet comprising a first permanent magnet to cancel the field of the second magnet comprising a second permanent magnet.

19. The method of claim 14, comprising programming the wall attachment condition to be based, at least in part, on a depth measurement.

20. The method of claim 14, wherein switching a magnet to attach the UMT to the wall of the wellbore comprises changing a polarity of a field of the first magnet comprising a first permanent magnet to align with the field of the second magnet comprising a second permanent magnet.

21. The method of claim 14, comprising collecting temperature data while the UMT is attached to the wall of the wellbore.

22. The method of claim 14, comprising collecting pressure data while the UMT is attached to the wall of the wellbore.

23. The method of claim 14, comprising collecting composition data while the UMT is attached to the wall of the wellbore.

24. The method of claim 14, comprising collecting seismic data while the UMT is attached to the wall of the wellbore.

25. The method of claim 14, comprising collecting corrosion rate based on a coupon resistivity measurement while the UMT is attached to the wall of the wellbore.

26. The method of claim 14, comprising collecting density and viscosity data while the UMT is attached to the wall of the wellbore.

27. The method of claim 14, comprising collecting casing wall thickness data while the UMT is attached to the wall of the wellbore.

28. The method of claim 14, comprising collecting flow rate data while the UMT is attached to the wall of the wellbore.

29. The method of claim 14, comprising collecting fluid phase data while the UMT is attached to the wall of the wellbore.

30. The method of claim 14, comprising preprogramming the wall release condition to be based, at least in part, on a time measurement.

31. The method of claim 14, comprising switching the second magnet to release the UMT from the wall of the wellbore when a charge on a battery reaches a determined set point.

32. The method of claim 31, wherein the determined set point is less than 20%.

* * * * *